US008881548B2

(12) United States Patent
Wakamoto et al.

(10) Patent No.: US 8,881,548 B2
(45) Date of Patent: Nov. 11, 2014

(54) AIR-CONDITIONING APPARATUS

(75) Inventors: Shinichi Wakamoto, Chiyoda-ku (JP); Koji Yamashita, Chiyoda-ku (JP); Naofumi Takenaka, Chiyoda-ku (JP); Yusuke Shimazu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 590 days.

(21) Appl. No.: 13/266,182

(22) PCT Filed: May 8, 2009

(86) PCT No.: PCT/JP2009/058693

§ 371 (c)(1),
(2), (4) Date: Oct. 25, 2011

(87) PCT Pub. No.: WO2010/128557

PCT Pub. Date: Nov. 11, 2010

(65) Prior Publication Data

US 2012/0036887 A1 Feb. 16, 2012

(51) Int. Cl.
*F25B 41/00* (2006.01)

(Continued)

(52) U.S. Cl.
CPC ..... *F25B 13/00* (2013.01); *F25B 2313/02741* (2013.01); *F25B 2313/0272* (2013.01);

(Continued)

(58) Field of Classification Search
CPC ..... F25B 25/005; F25B 2313/0272; F25B 13/006; F25B 2313/02741; F25B 2341/0662; F25B 9/06; F25B 2313/0231; F25B 13/0232; F25B 2313/0233; F25B 23/00
USPC ..... 62/126, 160, 175, 180, 196.1, 201, 202, 62/238.7, 225, 233, 513
See application file for complete search history.

(56) References Cited

U.S. PATENT DOCUMENTS 5,063,752 A 11/1991 Nakamura et al.
5,156,014 A 10/1992 Nakamura et al.

(Continued)

FOREIGN PATENT DOCUMENTS

CN 1886625 A 12/2006
JP 59 91566 6/1984

(Continued)

OTHER PUBLICATIONS

Office Action issued Aug. 13, 2013 in Japanese Patent Application No. 2011-512288 with English language translation.

(Continued)

*Primary Examiner* — Frantz Jules
*Assistant Examiner* — Emmanuel Duke
(74) *Attorney, Agent, or Firm* — Oblon, Spivak, McClelland, Maier & Neustadt, L.L.P.

(57) ABSTRACT

A multi-chamber type air-conditioning apparatus is provided in which a refrigerant whose effect on human bodies is a concern is prevented from leaking into a room or the like in which an indoor unit is installed, simultaneous operation of cooling and heating is possible, and performance deterioration by a refrigerant flow control device or drop of the cooling capacity of the indoor unit can be prevented.

A heat-source-side refrigerant cycle A in which compressor 11, an outdoor heat exchanger 13, a second refrigerant flow control device 25*b*, a first intermediate heat exchanger 21, a first refrigerant flow control device 25, a second intermediate heat exchanger 22, and a third refrigerant flow control device 25*c* are connected in series and a use-side refrigerant cycle B in which each of the first intermediate heat exchanger 21 and the second intermediate heat exchanger 22 and each indoor heat exchanger 31 are connected in series, and in each of the first intermediate heat exchanger 21 and the second intermediate heat exchanger 22, and a heat-source-side refrigerant circulating through the heat-source-side refrigerant cycle A and a use-side refrigerant circulating through the use-side refrigerant cycle B are made to exchange heat.

15 Claims, 21 Drawing Sheets

(51) Int. Cl.

| | |
|---|---|
| ***F25B 13/00*** | (2006.01) |
| ***F25B 25/00*** | (2006.01) |
| *F25B 9/06* | (2006.01) |
| *F25B 7/00* | (2006.01) |

(52) U.S. Cl.

CPC ..... *F25B 2313/006* (2013.01); *F25B 9/06* (2013.01); *F25B 25/005* (2013.01); *F25B 2313/0231* (2013.01); *F25B 2309/061* (2013.01); *F25B 2341/0662* (2013.01); *F25B 7/00* (2013.01)

USPC ..... 62/513

(56) References Cited

U.S. PATENT DOCUMENTS

| | | | |
|---|---|---|---|
| 5,237,833 | A | 8/1993 | Hayashida et al. |
| 2007/0271936 | A1 | 11/2007 | Wakamoto et al. |
| 2011/0088421 | A1 | 4/2011 | Wakamoto et al. |
| 2011/0113802 | A1 | 5/2011 | Wakamoto et al. |

FOREIGN PATENT DOCUMENTS

| | | | | |
|---|---|---|---|---|
| JP | 60-18465 | U | 2/1985 | |
| JP | 2 118372 | | 5/1990 | |
| JP | 3 017475 | | 1/1991 | |
| JP | 5-5576 | | 1/1993 | |
| JP | 5-52430 | | 3/1993 | |
| JP | 7 091753 | | 4/1995 | |
| JP | 2705031 | B2 | 1/1998 | |
| JP | 2001 289465 | | 10/2001 | |
| JP | 2002 323274 | | 11/2002 | |
| JP | 2003 307358 | | 10/2003 | |
| JP | 2003 343936 | | 12/2003 | |
| JP | 2003343936 | * | 12/2003 | ..... F25B 13/00 |
| JP | 2004 53069 | | 2/2004 | |
| JP | 2004 60956 | | 2/2004 | |
| JP | 2004053069 | * | 2/2004 | ..... F25D 11/00 |
| JP | 2004-324947 | A | 11/2004 | |
| JP | 2005 140444 | | 6/2005 | |
| JP | 2006 3079 | | 1/2006 | |
| JP | 2006 125790 | | 5/2006 | |
| JP | 2007 183045 | | 7/2007 | |
| JP | 2007 255889 | | 10/2007 | |
| KR | 1020030095613 | * | 12/2003 | ..... F24F 11/00 |

OTHER PUBLICATIONS

International Search Report Issued Jun. 30, 2009 in PCT/JP09/058693 Filed May 8, 2009.

Chinese Office Action issued Jul. 15, 2013, in China Patent Application No. 200980159188.1 (with English translation).

U.S. Appl. No. 13/266,247, filed Oct. 26, 2011, Takenaka, et al.

Japanese Office Action issued Dec. 18, 2012, in Japan Patent Application No. 2011-512288 (with English translation).

Combined Office Action and Search Report issued Jul. 3, 2012 in Chinese Patent Application No. 200880128932.7 with English language translation and English translation of categories of cited documents.

Office Action issued Aug. 14, 2012 in Japanese Patent Application No. 2010-509999 with English language translation.

Office Action issued Jan. 28, 2013 in Chinese Patent Application No. 200880128932.7 with English language translation.

Combined Chinese Office Action and Search Report issued Apr. 15, 2014 in Patent Application No. 200980159188.1 (with English language translation of the Office Action and English translation of categories of cited documents).

* cited by examiner

AIR-CONDITIONING APPARATUS

TECHNICAL FIELD

The present invention relates to an air-conditioning apparatus that uses a refrigeration cycle and particularly relates to a multi-chamber-type air-conditioning apparatus that is provided with a plurality of indoor units and is capable of simultaneously performing heating and cooling operations.

BACKGROUND ART

Hitherto, air-conditioning apparatuses have been known that are provided with an outdoor unit including a compressor and an outdoor heat exchanger; a plurality of indoor units, each having an indoor heat exchanger; and a relay unit which connects the outdoor unit and the indoor unit to each other and is capable of performing a cooling operation (heating only operation mode) or a heating operation (heating only operation mode) with all the plurality of indoor units or a cooling operation with some indoor units and a heating operation with the other indoor units at the same time (cooling-main operation mode in which a cooling operation capacity is larger than a heating operation capacity or a heating-main operation mode in which the heating operation capacity is larger than the cooling operation capacity).

As such an apparatus, there has been proposed "an air-conditioning apparatus in which a first branching section which switchably connects one of a plurality of indoor units to a first connection pipeline or a second connection pipeline and a second branching section which connects the other of the plurality of the indoor units to the second connection pipeline through a first flow control device connected to the indoor units, the first branching section and the second branching section are connected through a second flow control device, and a relay unit incorporating the first branching section, the second flow control device, and the second branching section is interposed between a heat source unit and the plurality of indoor units, and the heat source unit and the relay unit are connected by the first and second connection pipelines extending therebetween" is proposed (See Patent Document 1, for example).

Also, there has been proposed "a refrigeration cycle device comprising a first refrigerant cycle having at least one compressor, at least one outdoor heat exchanger, a first expansion device capable of changing an opening degree, a high-pressure pipeline installed in a vertical direction of a building having a plurality of floors, and a low-pressure pipeline; and a second refrigerant cycle having a second expansion device capable of changing an opening degree, an indoor heat exchanger, a gas pipeline installed in a horizontal direction of each floor, and a liquid pipeline and being installed on a predetermined floor of the building; characterized by having a first intermediate heat exchanger provided on a pipeline annularly connected to the high-pressure pipeline and exchanging heat between the first refrigerant cycle and the second refrigerant cycle during a heating operation and a second intermediate heat exchanger provided on a pipeline annularly connected to the low-pressure pipeline and exchanging heat between the first refrigerant cycle and the second refrigerant cycle during a cooling operation" (See Patent Document 2, for example).

[Patent Document 1] Japanese Unexamined Patent Application Publication No. 2-118372 (Page 3, FIG. 1)

[Patent Document 2] Japanese Unexamined Patent Application Publication No. 2003-343936 (Page 5, FIG. 1)

DISCLOSURE OF INVENTION

Problems to be Solved by the Invention

If a refrigerant used in a refrigeration cycle device such as an air-conditioning apparatus leaks, the toxicity and flammability of the refrigerant can cause a serious effect on human bodies and its safety can be a problem. Considering such circumstances, the concentration of a refrigerant that is allowed to leak into a room or the like in which an indoor unit is installed is determined by international standards. For example, the allowable concentration according to the international standards for R410A, which is one of Freon refrigerants, is 0.44 kg/m$^3$, the allowable concentration according to the international standards for carbon dioxide ($CO_2$) is 0.07 kg/m$^3$, and the allowable concentration according to the international standards for propane is 0.008 kg/m$^3$.

Since the air-conditioning apparatus described in Patent Document 1 is constituted by one refrigerant cycle, if the refrigerant leaks into a room or the like in which the indoor unit is installed, all the refrigerants in the refrigerant cycle leak into this room or the like. The air-conditioning apparatus might be using several tens of kilograms or more of the refrigerant, and if the refrigerant leaks into the room or the like in which the indoor unit of the air-conditioning apparatus is installed, it has been likely that the refrigerant concentration in this room or the like would exceed the allowable concentration determined by the international standards.

Also, in other prior-art air-conditioning apparatuses, when a heat-source-side refrigerant flows through a relay unit, it flows through a refrigerant flow control device. The refrigerant flow control device generally uses an electronic expansion valve and the like, pressure loss at the fully open position is large, and there has been a problem that performances of the air-conditioning apparatus have deteriorated. Moreover, if an electronic expansion valve having a large diameter is used in the refrigerant flow control device in order to reduce the pressure loss when the value of the refrigerant flow control device is fully open, there is also a problem that the size of the electronic expansion valve is enlarged.

In addition, when all the indoor units execute the cooling or heating operation mode, the heat-source-side refrigerant communicates through the plurality of intermediate heat exchangers in series. Thus, the heat-source-side refrigerant is gradually subjected to phase change (condensation or evaporation). Therefore, the dryness of the heat-source-side refrigerant differs depending on the intermediate heat exchanger and the heat exchange capacities are varied, the temperatures or the flows of the use-side refrigerant supplied by a pump from the intermediate heat exchangers to the indoor unit are different, and the cooling capacity or heating capacity of the indoor unit is deteriorated, which is a problem.

In the refrigeration cycle device described in Patent Document 2, the heat-source-side refrigerant cycle (heat-source-side refrigerant cycle) disposed in the branch unit and the outdoor unit are separated from the use-side refrigerant cycle (use-side refrigerant cycle) disposed in the branch unit and the indoor unit, and the amount of the refrigerant leaking into the room or the like can be reduced. However, in such a refrigeration cycle device, in a heating operation, the first refrigerant returns to the high-pressure pipe after exchanging heat with the second refrigerant and being cooled, and thus, entropy of the first refrigerant is lowered to a greater degree in the indoor unit installed on the more downstream side, and the heating capacity and heat exchange efficiency of the indoor unit are lowered. Also, in the cooling operation, too, the entropy of the first refrigerant gradually increases, and the cooling capacity and heat exchange efficiency decrease.

The present invention was made to solve the above problems and an object thereof is to provide a multi-chamber type air-conditioning apparatus in which simultaneous cooling and heating operations are possible such that a refrigerant whose effect on human bodies is a concern is prevented from leaking into a room or the like in which an indoor unit is installed, and performance deterioration by a refrigerant flow control device or dropping of the cooling capacity of the indoor unit can be prevented.

Means for Solving the Problems

An air-conditioning apparatus according to the present invention has a heat-source-side refrigerant cycle in which a compressor, an outdoor heat exchanger, a plurality of intermediate heat exchangers, and a first refrigerant flow control device disposed between each of the intermediate heat exchangers are connected in series and a first bypass pipe which bypasses the first refrigerant flow control device through a first opening/closing device is disposed and a plurality of use-side refrigerant cycles in each of which a plurality of indoor heat exchangers are connected to each of the plurality of intermediate heat exchangers in parallel, in which the compressor and the outdoor heat exchanger are provided in an outdoor unit, the plurality of intermediate heat exchangers, the first refrigerant flow control device, the first bypass pipe, and the first opening/closing device are disposed in a relay unit, the indoor heat exchangers are disposed in each of a plurality of indoor units, and each of the plurality of intermediate heat exchangers exchanges heat between a heat-source-side refrigerant circulating through the heat-source-side refrigerant cycle and a use-side refrigerant circulating through the use-side refrigerant cycle.

Advantages

With the air-conditioning apparatus according to the present invention, since the simultaneous cooling and heating operations is made possible while the heat-source-side refrigerant cycle and the use-side refrigerant cycle are made independent of each other, the heat-source-side refrigerant does not leak to a place where the indoor unit is installed. Therefore, by using a safe refrigerant for the use-side refrigerant, no bad effect is given to human bodies. Also, operation can be continued without causing a pressure drop in the heat-source-side refrigerant by the refrigerant flow control device, and highly efficient operation can be realized.

REFERENCE NUMERALS

Figure 1:
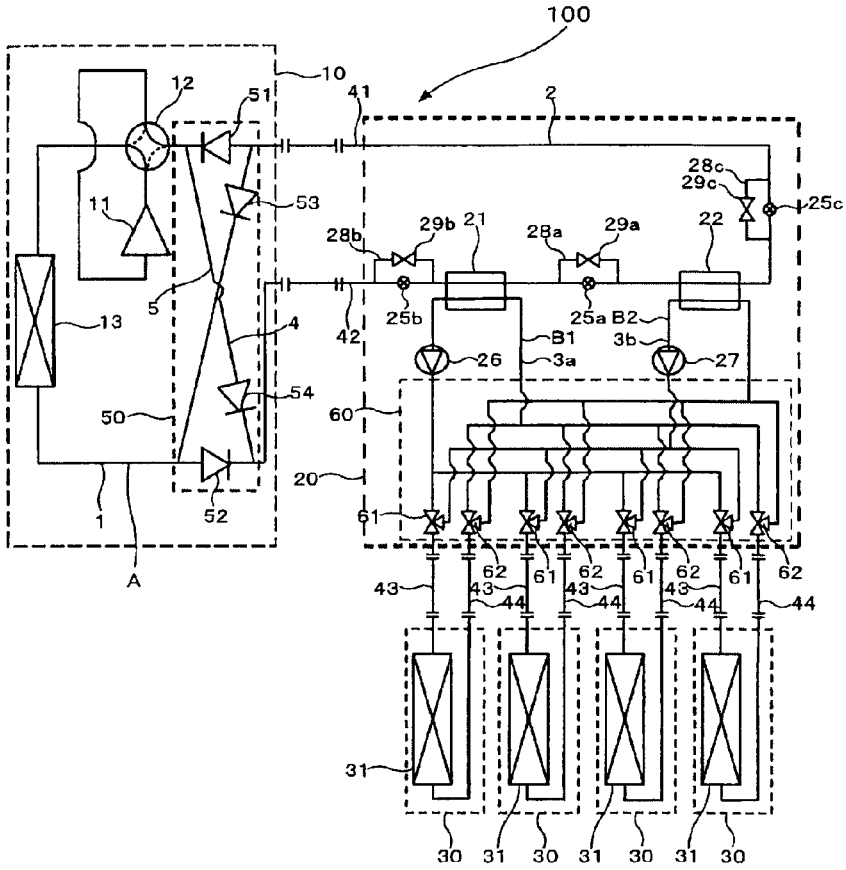
FIG. 1 is a circuit diagram illustrating a circuit configuration of an air-conditioning apparatus according to Embodiment 1 of the present invention.

1 heat-source-side refrigerant pipeline, 2 heat-source side refrigerant pipeline, 3 use-side refrigerant pipeline, 3*a* use-side refrigerant pipeline, 3*b* use-side refrigerant pipeline, 4 first connection pipeline, 4*a* first connection pipeline, 5 second connection pipeline, 5*a* second connection pipeline, 10 outdoor unit, 10*a* outdoor unit, 10*b* outdoor unit, 10*c* outdoor unit, 11 compressor, 12 four-way valve, 13 outdoor heat exchanger, 20 relay unit, 20*a* relay unit, 20*b* relay unit, 21 first intermediate heat exchanger, 22 second intermediate heat exchanger, 25 refrigerant flow control device, 25*a* first refrigerant flow control device, 25*b* second refrigerant flow control device, 25*c* third refrigerant flow control device, 25*d* fourth refrigerant flow control device, 25*e* fifth refrigerant flow control device, 26 first pump, 27 second pump, 28*a* first bypass pipe, 28*b* second bypass pipe, 28*c* third bypass pipe, 28*d* fourth bypass pipe, 29 opening/closing valve (opening/closing device), 29*a* first opening/closing valve (opening/closing device), 29*b* second opening/closing valve (opening/closing device), 29*c* third opening/closing valve (opening/closing device), 29*d* fourth opening/closing valve (opening/closing device), 30 indoor unit, 30*a* indoor unit, 30*b* indoor unit, 30*c* indoor unit, 30*d* indoor unit, 31 indoor heat exchanger, 41 first extension pipeline, 42 second extension pipeline, 43 third extension pipeline, 44 fourth extension pipeline, 50 heat-source-side refrigerant flow direction switching unit, 50*a* heat-source-side refrigerant flow direction switching unit, 51 first check valve, 51*a* first check valve, 52 second check valve, 52*a* second check valve, 53 third check valve, 53*a* third check valve, 54 fourth check valve, 54*a* fourth check valve, 60 use-side refrigerant flow direction switching unit, 61 first switching valve, 61*a* first switching valve, 61*b* first switching valve, 61*c* first switching valve, 61*d* first switching valve, 62 second switching valve, 62*a* second switching valve, 62*b* second switching valve, 62*c* second switching valve, 62*d* second switching valve, 65 bypass channel, 66 bypass opening/closing valve, 70 expansion mechanism, 71 expansion unit, 72 power transmission device, 73 sub compressor, 75 heat-source-side refrigerant flow direction switching unit, 76 check valve, 77 check valve, 78 check valve, 79 check valve, 80 cooling device, 81 second compressor, 82 second outdoor heat exchanger, 83 heat exchanger, 85 refrigerant pipeline, 100 air-conditioning apparatus, 200 air-conditioning apparatus, 300 air-conditioning apparatus, 400 air-conditioning apparatus, 700 building, 711 living space, 712 living space, 713 living space, 721 common space, 722 common space, 723 common space, 730 pipeline installation space, A heat-source-side refrigerant cycle, B use-side refrigerant cycle, B1 use-side refrigerant cycle, B2 use-side refrigerant cycle.

BEST MODES FOR CARRYING OUT THE INVENTION

Embodiments of the present invention will be described below while referring to the attached drawings.

Embodiment 1

FIG. 1 is a circuit diagram illustrating a circuit configuration of an air-conditioning apparatus 100 according to Embodiment 1 of the present invention. On the basis of FIG. 1, the circuit configuration of the air-conditioning apparatus 100 will be described. This air-conditioning apparatus 100 is installed in a building, an apartment house or the like and can supply a cooling load and a heating load at the same time by using a refrigeration cycle (a heat-source-side refrigerant cycle and a use-side refrigerant cycle) through which a refrigerant (heat-source-side refrigerant and a use-side refrigerant) is circulated. Including FIG. 1, the relationships among the sizes of constituent members might be different from actual ones in the following drawings.

As illustrated in FIG. 1, the air-conditioning apparatus 100 is provided with one outdoor unit 10, a plurality of indoor units 30, and one relay unit 20 which is interposed among these units. Also, this air-conditioning apparatus 100 can execute a cooling only operation mode in which all the indoor units 30 perform a cooling operation, a heating only operation mode in which all the indoor units 30 perform a heating operation, a simultaneous cooling and heating operation mode in which the cooling load is larger than the heating load (hereinafter referred to as a cooling-main operation mode), and a simultaneous cooling and heating operation mode in which the heating load is larger than the cooling load (hereinafter referred to as a heating-main operation mode). The numbers of the outdoor unit 10, the indoor units 30, and the relay unit 20 are not limited to the illustrated numbers.

The outdoor unit 10 has a function of supplying cooling energy to the indoor units 30 through the relay unit 20. The indoor units 30 are installed in rooms or the like, each having air conditioning areas and has a function of supplying air for cooling or air for heating to the air conditioning areas. The relay unit 20 connects the outdoor unit 10 and the indoor units 30 and has a function of transmitting the cooling energy supplied from the outdoor unit 10 to the indoor units 30. That is, the outdoor unit 10 and the relay unit 20 are connected to each other through a first intermediate heat exchanger 21 and a second intermediate heat exchanger 22 provided in the relay unit 20, and the relay unit 20 and the indoor units 30 are connected to each other through the first intermediate heat exchanger 21 and the second intermediate heat exchanger 22 provided in the relay unit 20. The configuration and function of each constituent device will be described below.

[Outdoor Unit 10]

The outdoor unit 10 is formed by connecting a compressor 11, a four-way valve 12, which is flow direction switching means, and an outdoor heat exchanger 13 in series with each other through a heat-source-side refrigerant pipeline 1. Also, in the outdoor unit 10, a heat-source-side refrigerant flow direction switching unit 50 formed of a first connection pipeline 4, a second connection pipeline 5, a check valve 51, a check valve 52, a check valve 53, and a check valve 54 is disposed. This heat-source-side refrigerant flow direction switching unit 50 has a function of maintaining the flow of the heat-source-side refrigerant which flows into the relay unit 20 in a certain direction regardless of the operation in which the indoor units 30 operates. An example in which the heat-source-side refrigerant flow direction switching unit 50 is disposed is exemplified here, but the heat-source-side refrigerant flow direction switching unit 50 does not have to be provided.

The check valve 51 is disposed in the heat-source-side refrigerant pipeline 1 between the relay unit 20 and the four-way valve 12 to allow the flow of the heat-source-side refrigerant only in a predetermined direction (direction from the relay unit 20 to the outdoor unit 10). The check valve 52 is disposed in the heat-source-side refrigerant pipeline 1 between the outdoor heat exchanger 13 and the relay unit 20 and allows the flow of the heat-source-side refrigerant only in a predetermined direction (direction from the outdoor unit 10 to the relay unit 20). The check valve 53 is disposed in the first connection pipeline 4 and allows communication of the heat-source-side refrigerant only in the direction from the heat-source-side refrigerant pipeline 1 connected to a first extension pipeline 41 to the heat-source-side refrigerant pipeline 1 connected to a second extension pipeline 42. The check valve 54 is disposed in the second connection pipeline 5 and allows communication of the heat-source-side refrigerant only in a direction from the heat-source-side refrigerant pipeline 1 connected to the first extension pipeline 41 to the heat-source-side refrigerant pipeline 1 connected to the second extension pipeline 42.

The first connection pipeline 4 connects the heat-source-side refrigerant pipeline 1 on the upstream side of the check valve 51 to the heat-source-side refrigerant pipeline 1 on the upstream side of the check valve 52 in the outdoor unit 10. The second connection pipeline 5 connects the heat-source-side refrigerant pipeline 1 on the downstream side of the check valve 51 to the heat-source-side refrigerant pipeline 1 on the downstream side of the check valve 52 in the outdoor unit 10. The first connection pipeline 4, the second connection pipeline 5, the check valve 51, the check valve 52, the check valve 53 disposed in the first connection pipeline 4, and the check valve 54 disposed in the second connection pipeline 5 form the heat-source-side refrigerant flow direction switching unit 50.

The compressor 11 sucks the heat-source-side refrigerant, compresses and brings the heat-source-side refrigerant into a high-temperature and high-pressure state and may be formed of an inverter compressor capable of controlling capacity, for example. The four-way valve 12 switches between the flow of the heat-source-side refrigerant in a heating operation and the flow of the heat-source-side refrigerant in a cooling operation. The outdoor heat exchanger 13 functions as an evaporator during the heating operation, functions as a condenser during the cooling operation, exchanges heat between air supplied from a fan, not shown, and the heat-source-side refrigerant and evaporates and gasifies or condenses and liquefies the heat-source-side refrigerant. The heat-source-side refrigerant flow direction switching unit 50 has a function of maintaining the flow direction of the heat-source-side refrigerant flowing into the relay unit 20 constant as described above.

[Indoor Unit 30]

In each of the indoor units 30, the indoor heat exchanger 31 is mounted. This indoor heat exchanger 31 is connected to a use-side refrigerant flow direction switching unit 60 disposed in the relay unit 20 through a third extension pipeline 43 and a fourth extension pipeline 44. The indoor heat exchanger 31 functions as a condenser during the heating operation, functions as an evaporator during the cooling operation, exchanges heat between the air supplied from the fan, not shown, and the use-side refrigerant (this use-side refrigerants will be described later in detail) and generates heating air or cooling air to be supplied to the air conditioning area.

[Relay Unit 20]

In the relay unit 20, a second refrigerant flow control device 25*b*, the first intermediate heat exchanger 21, a first refrigerant flow control device 25*a*, the second intermediate heat exchanger 22, and a third refrigerant flow control device 25*c* are connected in series in this order by the heat-source-side refrigerant pipeline 2 and mounted. Also, the relay unit 20 is provided with a second bypass pipe 28*b* that bypasses the second refrigerant flow control device 25*b*, a second opening/closing valve 29*b* that opens and closes a channel of the second bypass pipe 28*b*, a first bypass pipe 28*a* that bypasses the first refrigerant flow control device 25*a*, a first opening/closing valve 29*a* that opens and closes the channel of the first bypass pipe 28*a*, a third bypass pipe 28*c* that bypasses the third refrigerant flow control device 25*c*, and a third opening/closing valve 29*c* that opens and closes the channel of the third bypass pipe 28*c*.

Moreover, in the relay unit 20, a first pump 26, a second pump 27, and the use-side refrigerant flow direction switching unit 60 are disposed. The first intermediate heat exchanger 21, the first pump 26, and the use-side refrigerant flow direction switching unit 60 are connected in this order by a first use-side refrigerant pipeline 3*a*, and the second intermediate heat exchanger 22, the second pump 27, and the use-side refrigerant flow direction switching unit 60 are connected in this order by a second use-side refrigerant pipeline 3*b*. The first use-side refrigerant pipeline 3*a* and the second use-side refrigerant pipeline 3*b* are connected to the third extension pipeline 43 and the fourth extension pipeline 44. In the following explanation, the first use-side refrigerant pipeline 3*a* and the second use-side refrigerant pipeline 3*b* are collectively called a use-side refrigerant pipeline 3 in some cases.

The first intermediate heat exchanger 21 and the second intermediate heat exchanger 22 function as condensers or evaporators, exchange heat between the heat-source-side refrigerant and the use-side refrigerant and supply cooling energy to the indoor heat exchangers 31. The first refrigerant flow control device 25*a*, the second refrigerant flow control device 25*b*, and the third refrigerant flow control device 25*c* (hereinafter referred to as a refrigerant flow control device 25 in some cases) function as reducing valves or expansion valves and reduce and expand the heat-source-side refrigerant. This refrigerant flow control device 25 is preferably formed of a device capable of variably controlling an opening degree such as an electronic expansion valve, for example. The use-side refrigerant flow direction switching unit 60 selects either one of or both of the use-side refrigerant heat-exchanged by the first intermediate heat exchanger 21 or the use-side refrigerant heat-exchanged by the second intermediate heat exchanger 22 and supplies it to the indoor units 30. This use-side refrigerant flow direction switching unit 60 is provided with a plurality of water flow direction switching valves (first switching valves 61 and second switching valves 62).

The first switching valves 61 and the second switching valves 62 are disposed in a number corresponding to the number of indoor units 30 (here, four each) connected to the relay unit 20. Also, the use-side refrigerant pipeline 3 is branched corresponding to the number of the indoor units 30 (here, four branches each) connected to the relay unit 20 in the use-side refrigerant flow direction switching unit 60 and connects the third extension pipeline 43 and the fourth extension pipeline 44 connected to the use-side refrigerant flow direction switching unit 60 and the each of the indoor units 30. That is, the first switching valve 61 and the second switching valve 62 are disposed in each of the branched use-side refrigerant pipelines 3.

The first switching valve 61 is disposed in the use-side refrigerant pipeline 3 between the first pump 26 as well as the second pump 27 and each of the indoor heat exchangers 31, that is, in the use-side refrigerant pipeline 3 on the inflow side of the indoor heat exchanger 31. The first switching valve 61 is formed of a three-way valve, is connected to the first pump 26 and the second pump 27 through the use-side refrigerant pipeline 3 and is also connected to the third extension pipeline 43. Specifically, the first switching valve 61 connects the use-side refrigerant pipeline 3*a* as well as the use-side refrigerant pipeline 3*b* to the third extension pipeline 43 so as to switch the flow path of the use-side refrigerant by being controlled.

The second switching valve 62 is disposed in the use-side refrigerant pipeline 3 between the indoor heat exchanger 31, and the first intermediate heat exchanger 21 and the second intermediate heat exchanger 22, that is, in the use-side refrigerant pipeline 3 on the outflow side of the indoor heat exchanger 31. The second switching valve 62 is formed of a three-way valve and is connected to the fourth extension pipeline 44 through the use-side refrigerant pipeline 3 and is connected to the first pump 26 and the second pump 27 through the use-side refrigerant pipeline 3. Specifically, the second switching valve 62 connects the fourth extension pipeline 44, the use-side refrigerant pipeline 3*a*, and the use-side refrigerant pipeline 3*b* to control them and the flow path of the use-side refrigerant is switched.

The first pump 26 is disposed in the first use-side refrigerant pipeline 3*a* between the first intermediate heat exchanger 21 and the first switching valve 61 of the use-side refrigerant flow direction switching unit 60 and circulates the use-side refrigerant flowing through the first use-side refrigerant pipeline 3*a*, the third extension pipeline 43, and the fourth extension pipeline 44. The second pump 27 is disposed in the second use-side refrigerant pipeline 3*b* between the second intermediate heat exchanger 22 and the first switching valve 61 of the use-side refrigerant flow direction switching unit 60 and circulates the use-side refrigerant flowing through the second use-side refrigerant pipeline 3*b*, the third extension pipeline 43 and the fourth extension pipeline 44. The types of the first pump 26 and the second pump 27 are not particularly limited and may be formed of those capable of controlling capacity.

In this air-conditioning apparatus 100, the compressor 11, the four-way valve 12, the outdoor heat exchanger 13, the second refrigerant flow control device 25*b*, the first intermediate heat exchanger 21, the first refrigerant flow control device 25*a*, the second intermediate heat exchanger 22, and the third refrigerant flow control device 25*c* are connected in series in this order by the heat-source-side refrigerant pipeline 1, the first extension pipeline 41, the heat-source-side pipeline 2, and the second extension pipeline 42, and the second bypass pipe 28*b* that bypasses the second refrigerant flow control device 25*b*, the first bypass pipe 28*a* that bypasses the first refrigerant flow control device 25*a*, the third bypass pipe 28*c* that bypasses the third refrigerant flow control device 25*c*, the first opening/closing valve 29*a* that opens and closes the channel of the first bypass pipe 28*a*, the second opening/closing valve 29*b* that opens and closes the channel of the second bypass pipe 28*b*, and the third opening/closing valve 29 that opens and closes the channel of the third bypass pipe 28*c* are disposed so as to constitute a heat-source-side refrigerant cycle A.

Also, the first intermediate heat exchanger 21, the first pump 26, the first switching valve 61, the indoor heat exchanger 31, and the second switching valve 62 are connected in series in this order by the first use-side refrigerant pipeline 3*a*, the third extension pipeline 43, and the fourth extension pipeline 44 so as to constitute a first use-side refrigerant cycle B1. Similarly, the second intermediate heat exchanger 22, the second pump 27, the first switching valve 61, the indoor heat exchanger 31, and the second switching valve 62 are connected in series in this order by the second use-side refrigerant pipeline 3*b*, the third extension pipeline 43, and the fourth extension pipeline 44 so as to constitute a second use-side refrigerant cycle B2.

That is, the air-conditioning apparatus 100 is configured such that the outdoor unit 10 and the relay unit 20 are connected to each other through the first intermediate heat exchanger 21 and the second intermediate heat exchanger 22 disposed in the relay unit 20, and the relay unit 20 and the indoor units 30 are connected to each other through the use-side refrigerant flow direction switching unit 60 disposed in the relay unit 20. In the air-conditioning apparatus 100, the heat-source-side refrigerant circulating through the heat-source-side refrigerant cycle A exchange heat with the use-side refrigerant circulating through the first use-side refrigerant cycle B1 in the first intermediate heat exchanger 21, and the heat-source-side refrigerant circulating through the heat-source-side refrigerant cycle A exchange heat with the use-side refrigerant circulating through the second use-side refrigerant cycle B2 in the second intermediate heat exchanger 22, respectively. In the following explanation, the first use-side refrigerant cycle B1 and the second use-side refrigerant cycle B2 are collectively referred to as a use-side refrigerant cycle B in some cases.

The first extension pipeline 41 and the second extension pipeline 42 connect the outdoor unit 10 and the relay unit 20 through the heat-source-side refrigerant pipeline 1 and the heat-source-side refrigerant pipeline 2. The first extension pipeline 41 and the second extension pipeline 42 can be separated between the outdoor unit 10 and the relay unit 20 so that the outdoor unit 10 and the relay unit 20 can be separated from each other. Also, the third extension pipeline 43 and the fourth extension pipeline 44 connect the relay unit 20 and the indoor units 30 through the use-side refrigerant pipeline 3. The third extension pipeline 43 and the fourth extension pipeline 44 can be separated between the relay unit 20 and the indoor units 30 so that the relay unit 20 and the indoor units can be separated from each other.

Here, the types of the refrigerant used in the heat-source-side refrigerant cycle A and the use-side refrigerant cycle B will be described. In the heat-source-side refrigerant cycle A, a non-azeotropic refrigerant mixture such as R407C, a near-azeotropic refrigerant mixture such as R410A or a single refrigerant such as R22 and the like can be used. Also, a natural refrigerant such as carbon dioxide, hydrocarbon and the like or a refrigerant having global warming potential lower than that of R407 or R410A may be also used. By using a natural refrigerant or a refrigerant having global warming potential lower than that of R407C or R410A such as a refrigerant having tetrafluoropropene as a main component for a heat-source-side refrigerant, for example, an advantage of suppressing a greenhouse effect of the earth caused by refrigerant leakage can be obtained. Particularly, since carbon dioxide exchanges heat without condensation with the high-pressure side in the super-critical state, by providing the heat-source-side refrigerant flow direction switching unit 50 and by arranging the heat-source-side refrigerant cycle A and the use-side refrigerant cycle B in a countercurrent form in the first intermediate heat exchanger 21 and the second intermediate heat exchanger 22 as illustrated in FIG. 1, heat exchange performance when water is heated can be improved.

The use-side refrigerant cycle B is connected to the indoor heat exchangers 31 of the indoor units 30 as described above. Thus, in the air-conditioning apparatus 100, considering leakage of the use-side refrigerant into a room or the like in which the indoor unit 30 is installed, a safe refrigerant is used for the use-side refrigerant. Therefore, water, an anti-freezing fluid, a mixed solution of water and an anti-freezing fluid, a mixed solution of water and additives with high anti-corrosion effect or the like, for example, can be used for the use-side refrigerant. According to this configuration, refrigerant leakage caused by freezing or corrosion can be prevented even at a low outside air temperature, whereby high reliability can be obtained. Also, if the indoor unit 30 is installed in a place where moisture should be avoided such as a computer room, a fluorine inactive liquid with high insulation can be also used as the use-side refrigerant.

Here, each operation mode that the air-conditioning apparatus 100 operates will be described. The air-conditioning apparatus 100 is capable of performing a cooling operation or a heating operation by utilizing the indoor units 30 thereof on the basis of an instruction from each indoor unit 30. That is, the air-conditioning apparatus 100 is capable of performing the same operation with all the indoor units 30 and also of different operations with each of the indoor units 30. Four operation modes in which the air-conditioning apparatus 100 operates, that is, a cooling only operation mode, a heating only operation mode, a cooling-main operation mode, and a heating-main operation mode will be described below with a flow of the refrigerant.

[Cooling Only Operation Mode]

Figure 2:
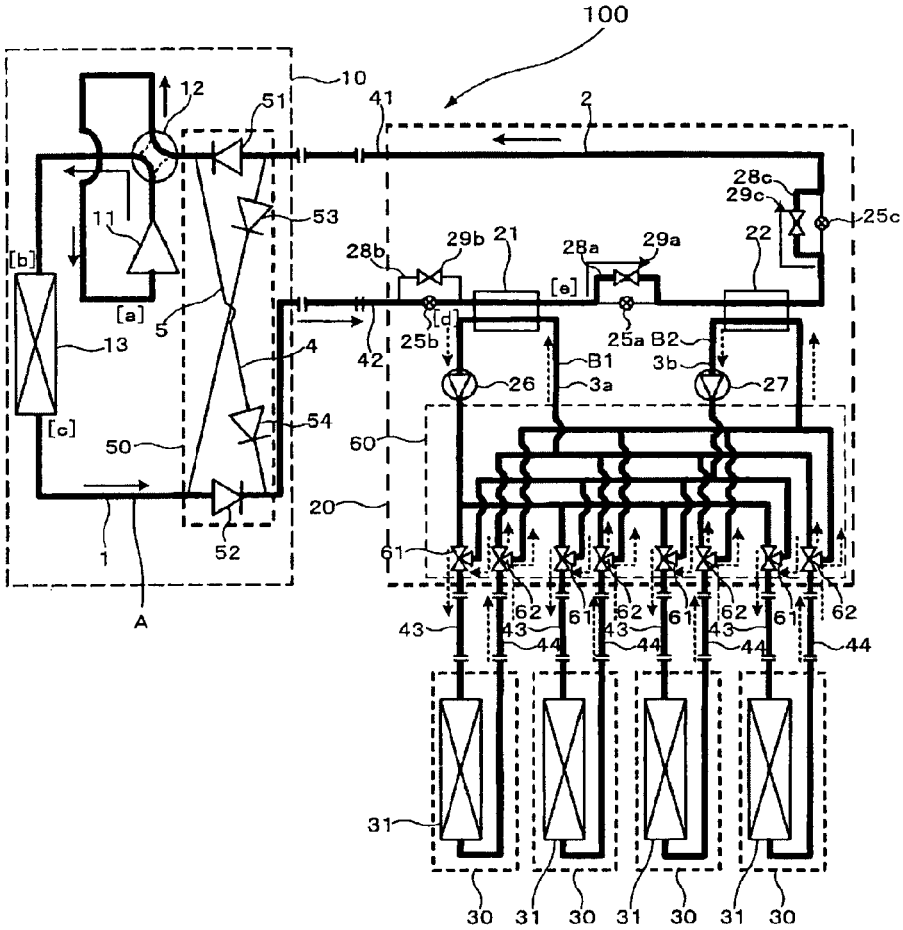
FIG. 2 is a refrigerant cycle diagram illustrating the flow of a refrigerant in a cooling only operation mode of the air-conditioning apparatus according to Embodiment 1 of the present invention.
Figure 3:
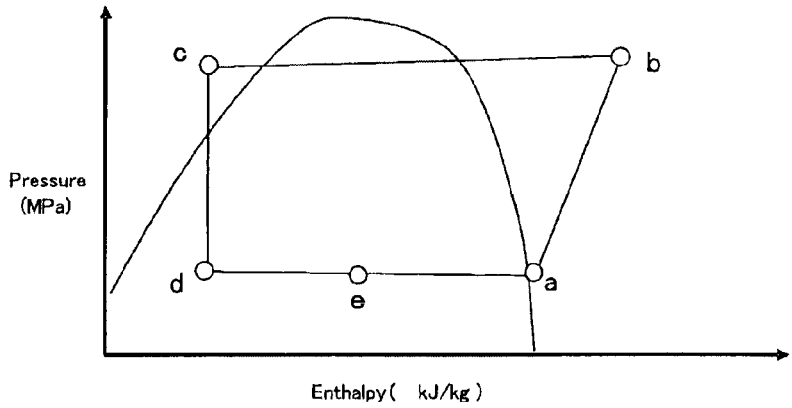
FIG. 3 is a p-h diagram illustrating transition of a heat-source-side refrigerant in the cooling only operation mode of the air-conditioning apparatus according to Embodiment 1 of the present invention.

FIG. 2 is a refrigerant cycle diagram illustrating the flow of a refrigerant in the cooling only operation mode of the air-conditioning apparatus 100. FIG. 3 is a p-h diagram (a diagram illustrating the relationship between the pressure of the refrigerant and enthalpy) illustrating transition of the heat-source-side refrigerant in this cooling only operation mode. In FIG. 2, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 3 correspond to the refrigerant states at [a] to [e] illustrated in FIG. 2, respectively.

If all the indoor units 30 perform the cooling operation, in the outdoor unit 10, the four-way valve 12 is switched so that the heat-source-side refrigerant discharged from the compressor 11 flows into the outdoor heat exchanger 13. In the relay unit 20, the opening degree of the second refrigerant flow control device 25*b* is decreased, the first refrigerant flow control device 25*a* and the third refrigerant flow control device 25*c* are fully closed, the second opening/closing valve 29*b* is fully closed, the first opening/closing valve 29*a* and the third opening/closing valve 29*c* are fully open, the first pump 26 and the second pump 27 are made to run, the first switching valve 61 and the second switching valve 62 of the use-side refrigerant flow direction switching unit 60 are switched so that the use-side refrigerant circulates between the first intermediate heat exchanger 21 as well as the second intermediate heat exchanger 22 and each of the indoor units 30. In this state, the operation of the compressor 11 is started. The first refrigerant flow control device 25*a* and the third refrigerant flow control device 25*c* may be fully open.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. Assuming that heat does not go to or come from the periphery, this refrigerant compression process of this compressor 11 is represented by an isentropic line illustrated from the point [a] to the point [b] in FIG. 3. The high-temperature and high-pressure refrigerant discharged from the compressor 11 passes through the four-way valve 12 and flows into the outdoor heat exchanger 13. Then, the refrigerant is condensed and liquefied while releasing heat to the outdoor air in the outdoor heat exchanger 13 and becomes a high-pressure liquid refrigerant. The change of the refrigerant in the outdoor heat exchanger 13 progresses under the substantially constant pressure. The refrigerant change at this time is, considering pressure loss in the outdoor heat exchanger 13, represented by a slightly inclined straight line close to horizontal as indicated from the point [b] to the point [c] in FIG. 3.

The high-pressure liquid refrigerant having flowed out of the outdoor heat exchanger 13 flows through the second extension pipeline 42 through the heat-source-side refrigerant flow direction switching unit 50 (check valve 52) and flows into the relay unit 20. The high-pressure liquid refrigerant having flowed into the relay unit 20 is expanded (reduced) by the second refrigerant flow control device 25*b* and enters a low-temperature and low-pressure gas-liquid two-phase state. The change of the refrigerant in the second refrigerant flow control device 25*b* progresses under the constant enthalpy. The refrigerant change at this time is represented by a perpendicular line indicated from the point [c] to the point [d] in FIG. 3.

The gas-liquid two-phase state refrigerant having been expanded by the second refrigerant flow control device 25*b* flows into the first intermediate heat exchanger 21. The refrigerant having flowed into the first intermediate heat exchanger 21 takes heat away from the use-side refrigerant circulating through the first use-side refrigerant cycle B1 and enters the low-temperature and low-pressure gas-liquid two-phase state while cooling the use-side refrigerant. The change of the refrigerant in the first intermediate heat exchanger 21 progresses under the substantially constant pressure. The change of the refrigerant at this time is, considering pressure loss in the first intermediate heat exchanger 21, represented by a slightly inclined straight line close to horizontal as indicated from the point [d] to [e] in FIG. 3. The heat-source-side refrigerant having flowed out of the first intermediate heat exchanger 21 flows into the second intermediate heat exchanger 22 through the first bypass pipe 28*a* and the first opening/closing valve 29*a*.

The refrigerant having flowed into the second intermediate heat exchanger 22 takes heat away from the use-side refrigerant circulating through the second use-side refrigerant cycle B2 and becomes a low-temperature and low-pressure vapor refrigerant while cooling the use-side refrigerant. The change of the refrigerant in the second intermediate heat exchanger 22 progresses under the substantially constant pressure. The refrigerant change at this time is, considering the pressure loss in the second intermediate heat exchanger 22, represented by a slightly inclined straight line close to horizontal indicated from the point [e] to [a] in FIG. 3. The low-temperature and low-pressure vapor refrigerant having flowed out of the second intermediate heat exchanger 22 flows through the third bypass pipe 28*c*, the third opening/closing valve 29*c*, and the first extension pipeline 41 and returns to the compressor 11 through the heat-source-side refrigerant flow direction switching unit 50 (check valve 51) and the four-way valve 12.

Since the low-temperature and low-pressure vapor refrigerant flowing into the compressor 11 flows through the refrigerant pipeline, the pressure is somewhat lower than that of the low-temperature and low-pressure vapor refrigerant immediately after flowing out of the second intermediate heat exchanger 22, but it is represented by the same point [a] in FIG. 3. Since such pressure loss of the refrigerant caused by passage through the pipeline or pressure loss in the outdoor heat exchanger 13, the first intermediate heat exchanger 21 and the second intermediate heat exchanger 22 are the same as in the heating only operation mode, the cooling-main operation mode, and the heating-main operation mode described below, the explanation will be omitted except when necessary.

Subsequently, the flow of the use-side refrigerant in the use-side refrigerant cycle B will be described. In the cooling only operation mode, since the first pump 26 and the second pump 27 are operated, the use-side refrigerant circulates through each of the first use-side refrigerant cycle B1 and the second use-side refrigerant cycle B2. The use-side refrigerants having been cooled by the heat-source-side refrigerant in the first intermediate heat exchanger 21 and the second intermediate heat exchanger 22 flows into the use-side refrigerant flow direction switching unit 60 by the first pump 26 and the second pump 27, respectively. The use-side refrigerants having flowed into the use-side refrigerant flow direction switching unit 60 pass through the use-side refrigerant pipeline 3 and merge at the first switching valve 61 and then, flow through the third extension pipeline 43 and flow into each of the indoor units 30.

Then, in the indoor heat exchanger 31 mounted on the indoor unit 30, the refrigerant takes heat away from the indoor air and cools the air conditioning area such as a room or the like in which the indoor unit 30 is installed. After that, the use-side refrigerant having flowed out of the indoor heat exchanger 31 passes through the fourth extension pipeline 44, branches at the second switching valve 62 and merges with the use-side refrigerants, each having flowed in from the other indoor units 30, in the use-side refrigerant flow direction switching unit 60 and then, flows into the first intermediate heat exchanger 21 and the second intermediate heat exchanger 22 again, respectively.

[Heating Only Operation Mode]

Figure 4:
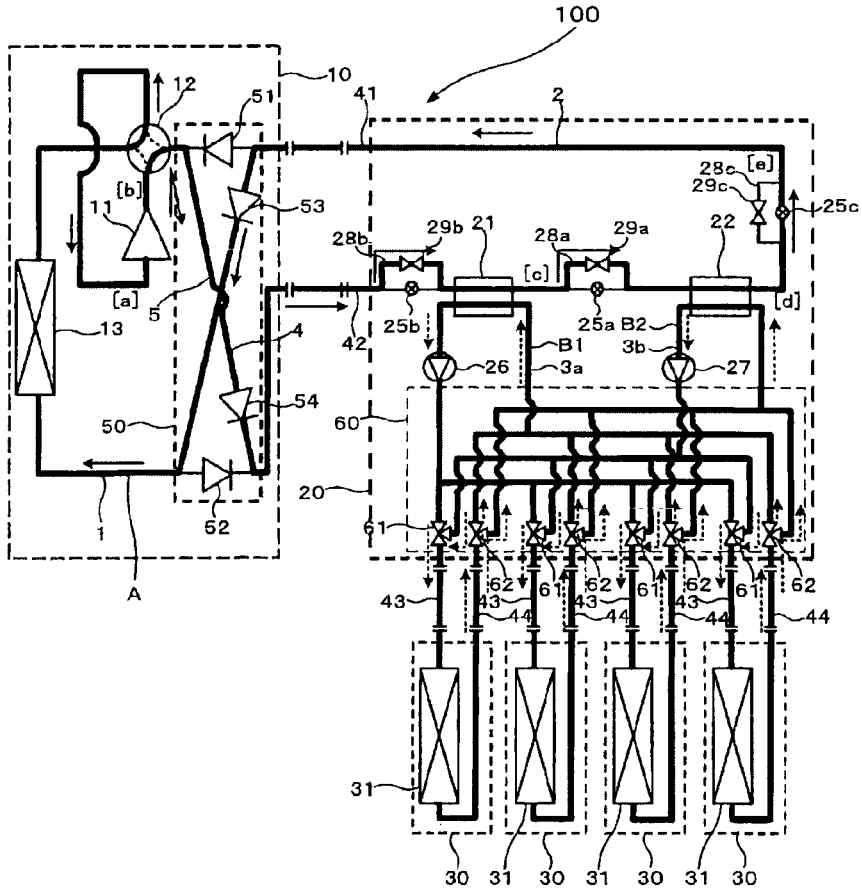
FIG. 4 is a refrigerant cycle diagram illustrating the flow of a refrigerant in a heating only operation mode of the air-conditioning apparatus according to Embodiment 1 of the present invention.
Figure 5:
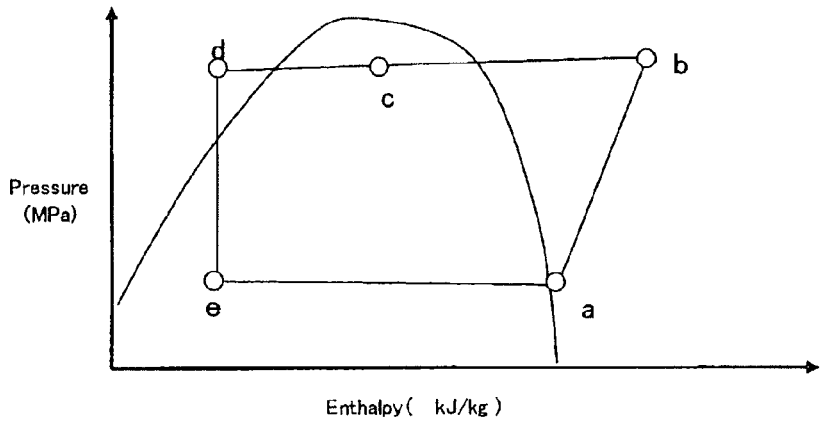
FIG. 5 is a p-h diagram illustrating transition of the heat-source-side refrigerant in the heating only operation mode of the air-conditioning apparatus according to Embodiment 1 of the present invention.

FIG. 4 is a refrigerant cycle diagram illustrating the flow of a refrigerant in the heating only operation mode of the air-conditioning apparatus 100. FIG. 5 is a p-h diagram (a diagram illustrating the relationship between the pressure of the refrigerant and enthalpy) illustrating transition of the heat-source-side refrigerant in this heating only operation mode. In FIG. 4, a pipeline illustrated by a bold line indicates a pipeline through which the refrigerant (the heat-source-side refrigerant and the use-side refrigerant) circulates. Also, the flow direction of the heat-source-side refrigerant is indicated by solid-line arrows, while the flow direction of the use-side refrigerant by broken-line arrows. Moreover, the refrigerant states at a point [a] to a point [e] illustrated in FIG. 5 correspond to the refrigerant states at [a] to [e] illustrated in FIG. 4, respectively.

If all the indoor units 30 perform the heating operation, in the outdoor unit 10, the four-way valve 12 is switched so that the heat-source-side refrigerant discharged from the compressor 11 flows into the relay unit 20 without going through the outdoor heat exchanger 13. In the relay unit 20, the first refrigerant flow control device 25*a* and the second refrigerant flow control device 25*b* are fully closed, the opening degree of the third refrigerant flow control device 25*c* is decreased, the first opening/closing valve 29*a* and the second opening/closing valve 29*b* are fully open, the third opening/closing valve 29*c* is fully closed, the first pump 26 and the second pump 27 are made to run, the first switching valve 61 and the second switching valve 62 of the use-side refrigerant flow direction switching unit 60 are switched so that the use-side refrigerants from the first intermediate heat exchanger 21 and the second intermediate heat exchanger 22 circulate between them and each of the indoor units 30. In this state, the operation of the compressor is started. The first refrigerant flow control device 25*a* and the second refrigerant flow control device 25*b* may be fully open.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. This refrigerant compression process in the compressor 11 is represented by an isentropic line illustrated from the point [a] to the point [b] in FIG. 5. The high-temperature and high-pressure refrigerant discharged from the compressor 11 flows through the second extension pipeline 42 through the four-way valve 12 and the heat-source-side refrigerant flow direction switching unit 50 (check valve 54), passes through the second bypass pipe 28*b* and the second opening/closing valve 29*b* of the relay unit 20 and flows into the first intermediate heat exchanger 21. Then, the refrigerant having flowed into the first intermediate heat exchanger 21 is condensed and liquefied while releasing heat to the use-side refrigerant circulating through the first use-side refrigerant cycle B1 and becomes a high-pressure gas-liquid two-phase refrigerant. The refrigerant change at this time is represented by a slightly inclined straight line close to horizontal as indicated from the point [b] to the point [c] in FIG. 5.

The high-pressure gas-liquid two-phase refrigerant having flowed out of the first intermediate heat exchanger 21 passes through the first bypass pipe 28*a* and the first opening/closing valve 29*a* and flows into the second intermediate heat exchanger 22. The gas-liquid two-phase refrigerant having flowed into the second intermediate heat exchanger 22 is condensed and liquefied while releasing heat to the use-side refrigerant circulating through the second use-side refrigerant cycle B2 and becomes a high-pressure liquid refrigerant. The refrigerant change at this time is represented by a slightly inclined straight line close to horizontal indicated from the point [c] to the point [d] in FIG. 5. This liquid refrigerant flows through the heat-source-side refrigerant pipeline 2, expanded (reduced) by the third refrigerant flow control device 25*c* and enters the low-temperature and low-pressure gas-liquid two-phase state. The refrigerant change at this time is represented by the perpendicular line indicated from the point [d] to the point [e] in FIG. 5.

The refrigerant in the gas-liquid two-phase state having been expanded by the third refrigerant flow control device 25*c* flows through the heat-source-side refrigerant pipeline 2 and the first extension pipeline 41 and flows into the outdoor unit 10. This refrigerant flows into the outdoor heat exchanger 13 through the heat-source-side refrigerant flow direction switching unit 50 (check valve 53). Then, the refrigerant takes heat away from the outdoor air in the outdoor heat exchanger 13 and becomes a low-temperature and low-pressure vapor refrigerant. The refrigerant change at this time is represented by a slightly inclined straight line close to horizontal indicated from the point [e] to the point [a] in FIG. 5. The low-temperature and low-pressure vapor refrigerant having flowed out of the outdoor heat exchanger 13 returns to the compressor 11 through the four-way valve 12.

Subsequently, the flow of the use-side refrigerant in the use-side refrigerant cycle B will be described. In the heating only operation mode, the first pump 26 and the second pump 27 are made to run, and the use-side refrigerant circulates through each of the first use-side refrigerant cycle B1 and the second use-side refrigerant cycle B2. The use-side refrigerant having been heated by the heat-source-side refrigerant in the first intermediate heat exchanger 21 and the second intermediate heat exchanger 22 flows into the use-side refrigerant flow direction switching unit 60 by the first pump 26 and the second pump 27, respectively. The use-side refrigerants having flowed into the use-side refrigerant flow direction switching unit 60 pass through the use-side refrigerant pipeline 3 and merge at the first switching valve 61 and then, flow through the third extension pipeline 43 and flow into each of the indoor units 30.

Then, in the indoor heat exchanger 31 mounted on the indoor unit 30, the refrigerant releases heat to the indoor air and heats the air conditioning apace such as a room in which the indoor unit 30 is installed. After that, the use-side refrigerants having flowed out of the indoor heat exchanger 31 pass through the fourth extension pipeline 44 and branch at the second switching valve 62 and then, merge in the use-side refrigerant flow direction switching unit 60 and then, flow into the first intermediate heat exchanger 21 and the second intermediate heat exchanger 22 again, respectively.

[Cooling-Main Operation Mode]

Figure 6:
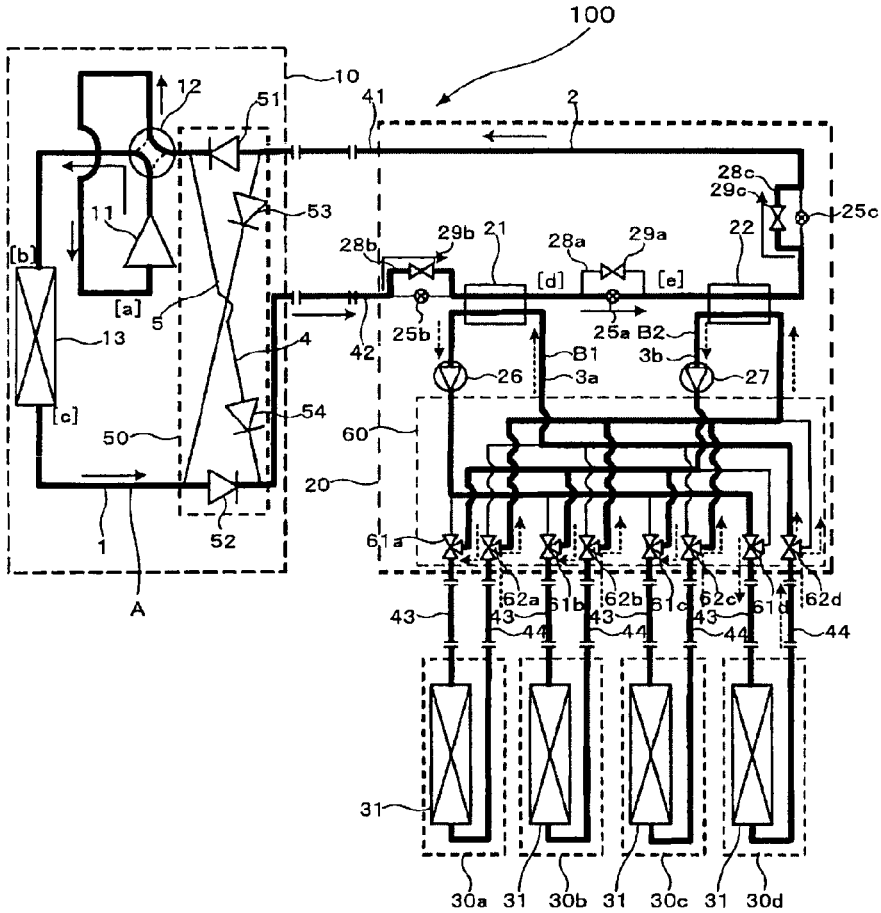
FIG. 6 is a refrigerant cycle diagram illustrating the flow of a refrigerant in a cooling-main operation mode of the air-conditioning apparatus according to Embodiment 1 of the present invention.
Figure 7:
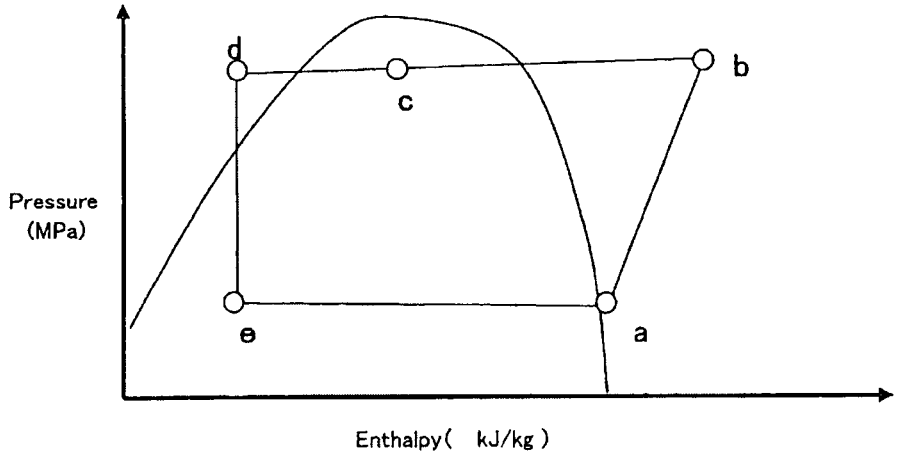
FIG. 7 is a p-h diagram illustrating transition of the heat-source-side refrigerant in the cooling-main operation mode of the air-conditioning apparatus according to Embodiment 1 of the present invention.

FIG. 6 is a refrigerant cycle diagram illustrating the flow of the refrigerant in the cooling-main operation mode of the air-conditioning apparatus 100. FIG. 7 is a p-h diagram (a diagram illustrating the relationship between the pressure of the refrigerant and enthalpy) illustrating transition of the heat-source-side refrigerant in this cooling-main operation mode. In FIG. 6, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 7 correspond to the refrigerant states at [a] to [e] illustrated in FIG. 6, respectively.

This cooling-main operation mode is a simultaneous cooling and heating operation mode in which three indoor units 30 performs a cooling operation and one indoor unit 30 perform a heating operation and the cooling load is larger, for example. In FIG. 6, the three indoor units 30 performing the cooling operation are indicated as an indoor unit 30*a*, an indoor unit 30*b*, and an indoor unit 30*c* from the left side in the figure, and the one indoor unit 30 on the right side in the figure which performs the heating operation is indicated as an indoor unit 30*d*. Also, in accordance with the indoor unit 30*a* to the indoor unit 30*d*, the first switching valves 61 to be connected to each of them are indicated as a first switching valve 61*a* to a first switching valve 61*d*, and the second switching valves 62 connected to each of them are indicated as a second switching valve 62*a* to a second switching valve 62*d*.

If the indoor units 30*a* to the indoor unit 30*c* perform the cooling operation and the indoor unit 30*d* performs the heating operation, in the outdoor unit 10, the four-way valve 12 is switched so that the heat-source-side refrigerant discharged from the compressor 11 flows into the outdoor heat exchanger 13. In the relay unit 20, the second refrigerant flow control device 25*b* and the third refrigerant flow control device 25*c* are fully closed, the opening degree of the first refrigerant flow control device 25*a* is decreased, the second opening/closing valve 29*b* and the third opening/closing valve 29*c* are fully open, the first opening/closing valve 29*a* is fully closed, and the first pump 26 and the second pump 27 are made to run. The second refrigerant flow control device 25*b* and the third refrigerant flow control device 25*c* may be fully open.

Also, in the use-side refrigerant flow direction switching unit 60 of the relay unit 20, the first switching valve 61*a* to the first switching valve 61*c* and the second switching valve 62*a* to the second switching valve 62*c* are switched so that the use-side refrigerant circulates between the second intermediate heat exchanger 22 and the indoor unit 30*a* to the indoor unit 30*c*, and the first switching valve 61*d* and the second switching valve 62*d* are switched so that the use-side refrigerant circulates between the first intermediate heat exchanger 21 and the indoor unit 30*d*. In this state, the operation of the compressor 11 is started.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. This refrigerant compression process in the compressor 11 is represented by an isentropic line illustrated from the point [a] to the point [b] in FIG. 7. The high-temperature and high-pressure refrigerant discharged from the compressor 11 flows through the four-way valve 12 and flows into the outdoor heat exchanger 13. Then, the refrigerant is condensed and liquefied while releasing heat to the outdoor air in the outdoor heat exchanger 13 and becomes a high-pressure gas-liquid two-phase refrigerant. The refrigerant change at this time is represented by a slightly inclined straight line close to horizontal as indicated from the point [b] to the point [c] in FIG. 7.

The high-pressure gas-liquid two-phase refrigerant having flowed out of the outdoor heat exchanger 13 flows through the second extension pipeline 42 through the heat-source side refrigerant flow direction switching unit 50 (check valve 52) and flows into the relay unit 20. The high-pressure gas-liquid two-phase refrigerant having flowed into the relay unit 20 passes through the second bypass pipe 28*b* and the second opening/closing valve 29*b* and is condensed and liquefied while releasing heat to the use-side refrigerant circulating through the first use-side refrigerant cycle B1 in the first intermediate heat exchanger 21 and becomes a high-pressure liquid refrigerant. That is, the first intermediate heat exchanger 21 functions as a condenser. The refrigerant change at this time is represented by a slightly inclined straight line close to horizontal as indicated from the point [c] to the point [d] in FIG. 7. The high-pressure liquid refrigerant having flowed out of the first intermediate heat exchanger 21 is expanded (reduced) by the first refrigerant flow control device 25*a* and enters the low-temperature and low-pressure gas-liquid two-phase state. The refrigerant change at this time is represented by a perpendicular line indicated from the point [d] to the point [e] in FIG. 7.

The gas-liquid two-phase refrigerant having been expanded in the first refrigerant flow control device 25*a* flows into the second intermediate heat exchanger 22. The refrigerant having flowed into the second intermediate heat exchanger 22 takes heat away from the use-side refrigerant circulating through the second use-side refrigerant cycle B2 while cooling the use-side refrigerant and becomes a low-temperature and low-pressure vapor refrigerant. That is, the second intermediate heat exchanger 22 functions as an evaporator. The refrigerant change at this time is represented by a slightly inclined straight line close to horizontal as indicated from the point [e] to the point [a] in FIG. 7. The low-temperature and low-pressure vapor refrigerant having flowed out of the second intermediate heat exchanger 22 passes through the third bypass pipe 28*c* and the third opening/closing valve 29*c* and flows through the heat-source-side refrigerant pipeline 2 and the first extension pipeline 41 and returns to the compressor 11 through the heat-source-side refrigerant flow direction switching unit 50 (check valve 51) and the four-way valve 12.

Subsequently, the flow of the use-side refrigerant in the use-side refrigerant cycle B will be described. In the cooling-main operation mode, since the first pump 26 and the second pump 27 are made to run, in both the first use-side refrigerant cycle B1 and the second use-side refrigerant cycle B2, the use-side refrigerant is circulated. That is, both the first intermediate heat exchanger 21 and the second intermediate heat exchanger 22 are functioning. First, the flow of the use-side refrigerant in the first use-side refrigerant cycle B1 when the indoor unit 30*d* performs the heating operation will be described, and then, the flow of the use-side refrigerant in the second use-side refrigerant cycle B2 when the indoor unit 30*a* to the indoor unit 30*c* perform the cooling operation will be described.

The use-side refrigerant having been heated by the heat-source-side refrigerant in the first intermediate heat exchanger 21 flows into the use-side refrigerant flow direction switching unit 60 by the first pump 26. The use-side refrigerant having flowed into the use-side refrigerant flow direction switching unit 60 flows through the first use-side refrigerant pipeline 3*a* connected to the first switching valve 61*d* and the third extension pipeline 43 and flows into the indoor heat exchanger 31 of the indoor unit 30*d*. Then, the refrigerant releases heat to the indoor air in the indoor heat exchanger 31 and performs the heating of the air conditioning area such as a room in which the indoor unit 30*d* is installed. After that, the use-side refrigerant having flowed out of the indoor heat exchanger 31 flows out of the indoor unit 30*d* and flows through the fourth extension pipeline 44 and the first use-side refrigerant pipeline 3*a* and flows into the first intermediate heat exchanger 21 again through the use-side refrigerant flow direction switching unit 60 (second switching valve 62*d*).

On the other hand, the use-side refrigerant having been cooled by the heat-source-side refrigerant in the second intermediate heat exchanger 22 flows into the use-side refrigerant flow direction switching unit 60 by the second pump 27. The use-side refrigerant having flowed into the use-side refrigerant flow direction switching unit 60 flows through the second use-side refrigerant pipeline 3*b* and the third extension pipeline 43 connected to the first switching valve 61*c* and flows into the indoor heat exchanger 31 of the indoor unit 30*a* to the indoor unit 30*c*. Then, the refrigerants take heat away from the indoor air in the indoor heat exchanger 31 and cool the air conditioning areas such as rooms in which the indoor unit 30*a* to the indoor unit 30*c* are installed. After that, the use-side refrigerants having flowed out of the indoor heat exchanger 31 flow out of the indoor unit 30*a* to the indoor unit 30*c*, flow through the fourth extension pipeline 44, the second switching valve 62*a* to the second switching valve 62*c* and the second use-side refrigerant pipeline 3*b* and merge in the use-side refrigerant flow direction switching unit 60 and then, flow into the second intermediate heat exchanger 22 again.

[Heating-Main Operation Mode]

Figure 8:
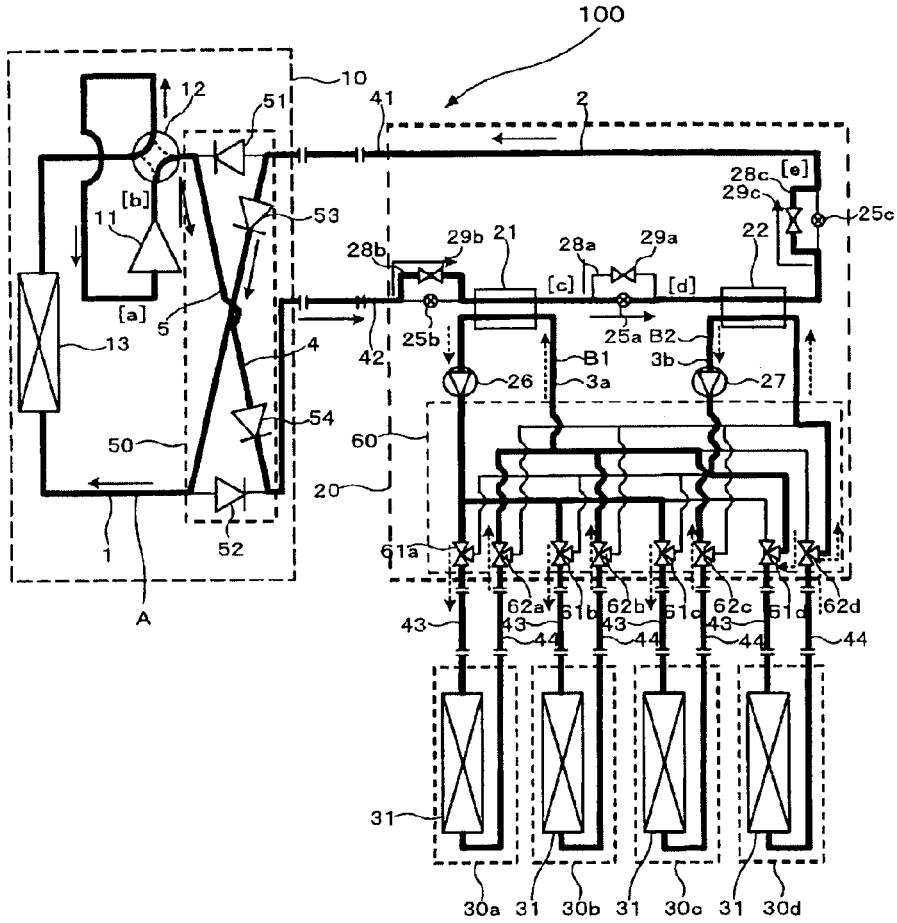
FIG. 8 is a refrigerant cycle diagram illustrating the flow of a refrigerant in the heating-main operation mode of the air-conditioning apparatus according to Embodiment 1 of the present invention.
Figure 9:
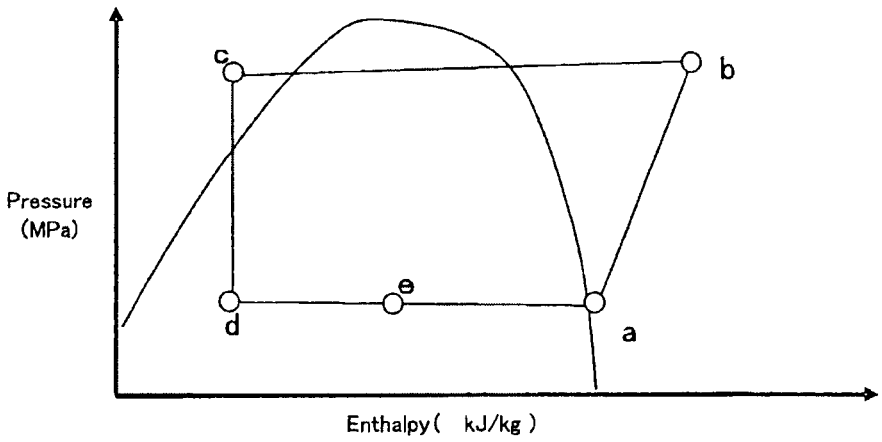
FIG. 9 is a p-h diagram illustrating transition of the heat-source-side refrigerant in the heating-main operation mode of the air-conditioning apparatus according to Embodiment 1 of the present invention.

FIG. 8 is a refrigerant cycle diagram illustrating the flow of the refrigerant in the heating-main operation mode of the air-conditioning apparatus 100. FIG. 9 is a p-h diagram (a diagram illustrating the relationship between the pressure of the refrigerant and enthalpy) illustrating transition of the heat-source-side refrigerant in this heating-main operation mode. In FIG. 8, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 9 correspond to the refrigerant states at [a] to [e] illustrated in FIG. 8, respectively.

This heating-main operation mode is a simultaneous cooling and heating operation mode in which the heating load is larger such that three indoor units 30 performs a heating operation and one indoor unit 30 performs a cooling operation, for example. In FIG. 8, the three indoor units 30 performing the heating operation are indicated as the indoor unit 30*a*, the indoor unit 30*b*, and the indoor unit 30*c* from the left side in the figure, and the one indoor unit 30 on the right side in the figure which performs the cooling operation is indicated as the indoor unit 30*d*. Also, in accordance with the indoor unit 30*a* to the indoor unit 30*d*, the first switching valves 61 to be connected to each of them are indicated as the first switching valve 61*a* to the first switching valve 61*d*, and the second switching valves 62 connected to each of them are indicated as the second switching valve 62*a* to the second switching valve 62*d*.

If the indoor unit 30*a* to the indoor unit 30*c* perform the heating operation and the indoor unit 30*d* performs the cooling operation, in the outdoor unit 10, the four-way valve 12 is switched so that the heat-source-side refrigerant discharged from the compressor 11 flows into the relay unit 20 without going through the outdoor heat exchanger 13. In the relay unit 20, the second refrigerant flow control device 25*b* and the third refrigerant flow control device 25*c* are fully closed, the opening degree of the first refrigerant flow control device 25*a* is decreased, the second opening/closing valve 29*b* and the third opening/closing valve 29*c* are fully open, the first opening/closing valve 29*a* is fully closed, and the first pump 26 and the second pump 27 are made to run. The second refrigerant flow control device 25*b* and the third refrigerant flow control device 25*c* may be fully open.

Also, in the use-side refrigerant flow direction switching unit 60 of the relay unit 20, the first switching valve 61*a* to the first switching valve 61*c* and the second switching valve 62*a* to the second switching valve 62*c* are switched so that the use-side refrigerant circulates between the first intermediate heat exchanger 21 and the indoor unit 30*a* to the indoor unit 30*c*, and the first switching valve 61*d* and the second switching valve 62*d* are switched so that the use-side refrigerant circulates between the second intermediate heat exchanger 22 and the indoor unit 30*d*. In this state, the operation of the compressor 11 is started.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. This refrigerant compression process in the compressor 11 is represented by an isentropic line illustrated from the point [a] to the point [b] in FIG. 9. The high-temperature and high-pressure refrigerant discharged from the compressor 11 flows through the second extension pipeline 42 through the four-way valve 12 and the heat-source-side refrigerant flow direction switching unit 50 (check valve 54), flows into the relay unit 20, flows through the second bypass pipe 28*b* and the second-opening/closing valve 29*b* and flows into the first intermediate heat exchanger 21. The refrigerant having flowed into the first intermediate heat exchanger 21 is condensed and liquefied while releasing heat to the use-side refrigerant circulating through the first use-side refrigerant cycle B1 and becomes a high-pressure liquid refrigerant. That is, the first intermediate heat exchanger 21 functions as a condenser. The refrigerant change at this time is represented by a slightly inclined straight line close to horizontal as indicated from the point [b] to the point [c] in FIG. 9.

The high-pressure liquid refrigerant having flowed out of the first intermediate heat exchanger 21 is expanded (reduced) by the first refrigerant flow control device 25*a* and enters a low-temperature and low-pressure gas-liquid two-phase state. The refrigerant change at this time is represented by a perpendicular line indicated from the point [c] to the point [d] in FIG. 9. The gas-liquid two-phase refrigerant having been expanded by the first refrigerant flow control device 25*a* flows into the second intermediate heat exchanger 22. The refrigerant having flowed into the second intermediate heat exchanger 22 takes heat away from the use-side refrigerant circulating through the second use-side refrigerant cycle B2 while cooling the use-side refrigerant and becomes a low-temperature and low-pressure gas-liquid two-phase refrigerant. That is, the second intermediate heat exchanger 22 functions as an evaporator. The refrigerant change at this time is represented by a slightly inclined straight line close to horizontal as indicated from the point [d] to the point [e] in FIG. 9.

The low-temperature and low-pressure gas-liquid two-phase refrigerant having flowed out of the second intermediate heat exchanger 22 passes through the third bypass pipe 28*c* and the third opening/closing valve 29*c*, flows through the heat-source-side refrigerant pipeline 2 and the first extension pipeline 41 and flows into the outdoor unit 10. This refrigerant flows into the outdoor heat exchanger 13 through the heat-source-side refrigerant flow direction switching unit 50 (check valve 53). Then, the refrigerant takes heat away from the outdoor air in the outdoor heat exchanger 13 and becomes a low-temperature and low-pressure vapor refrigerant. The refrigerant change at this time is represented by a slightly inclined straight line close to horizontal as indicated from the point [e] to the point [a] in FIG. 9. The low-temperature and low-pressure vapor refrigerant having flowed out of the outdoor heat exchanger 13 returns to the compressor 11 through the four-way valve 12.

Subsequently, the flow of the use-side refrigerant in the use-side refrigerant cycle B will be described. In the heating-main operation mode, since the first pump 26 and the second pump 27 are made to run, in both the use-side refrigerant cycle B1 and the second use-side refrigerant cycle B2, the use-side refrigerant is circulated. That is, both the first intermediate heat exchanger 21 and the second intermediate heat exchanger 22 are functioning. First, the flow of the use-side refrigerant in the first use-side refrigerant cycle B1 when the indoor unit 30*a* to the indoor unit 30*c* perform the heating operation will be described, and then, the flow of the use-side refrigerant in the second use-side refrigerant cycle B2 when the indoor unit 30*d* performs the cooling operation will be described.

The use-side refrigerant having been heated by the heat-source-side refrigerant in the first intermediate heat exchanger 21 flows into the use-side refrigerant flow direction switching unit 60 by the first pump 26. The use-side refrigerant having flowed into the use-side refrigerant flow direction switching unit 60 flows through the first use-side refrigerant pipeline 3*a* connected to the first switching valve 61*a* to the first switching valve 61*c* and the third extension pipeline 43 and flows into the indoor heat exchangers 31 of the indoor unit 30*a* to the indoor unit 30*c*. Then, the refrigerant releases heat to the indoor air in the indoor heat exchangers 31 and performs the heating of the air conditioning areas such as rooms in which the indoor unit 30*a* to the indoor unit 30*c* are installed. After that, the use-side refrigerants having flowed out of the indoor heat exchangers 31 flow out of the indoor unit 30*a* to the indoor unit 30*c* and flow through the fourth extension pipeline 44, the second switching valve 62*a* to the second switching valve 62*c*, and first the use-side refrigerant pipeline 3*a* and merge in the use-side refrigerant flow direction switching unit 60 and then, flow into the first intermediate heat exchanger 21 again.

On the other hand, the use-side refrigerant having been cooled by the heat-source-side refrigerant in the second intermediate heat exchanger 22 flows into the use-side refrigerant flow direction switching unit 60 by the second pump 27. The use-side refrigerant having flowed into the use-side refrigerant flow direction switching unit 60 flows through the second use-side refrigerant pipeline 3*b* connected to the first switching valve 61*d* and the third extension pipeline 43 and flows into the indoor heat exchanger 31 of the indoor unit 30*d*. Then, the refrigerant takes heat away from the indoor air in the indoor heat exchanger 31 and cools the air conditioning area such as a room in which the indoor unit 30*d* is installed. After that, the use-side refrigerant having flowed out of the indoor heat exchanger 31 flows out of the indoor unit 30*d*, flows through the fourth extension pipeline 44, the second switching valve 62*d*, and the second use-side refrigerant pipeline 3*b* and flows into the second intermediate heat exchange 22 again through the use-side refrigerant flow direction switching unit 60.

According to the air-conditioning apparatus 100 configured as above, since the use-side refrigerant such as water or an anti-freezing solution circulates through the first use-side refrigerant cycle B1 and the second use-side refrigerant cycle B2 connected to the indoor units 30 installed in spaces where people are present (living spaces, space where people come and go and the like), for example, leakage of the refrigerant from which effect on human bodies or safety is a concern into the space where people are present can be prevented. Also, according to the air-conditioning apparatus 100, since the circuit configuration which enables the simultaneous cooling and heating operation is provided in the relay unit 20, the outdoor unit 10 and the relay unit 20 can be connected to each other by two extension pipelines (the first extension pipeline 41 and the second extension pipeline 42) and the relay unit 20 and the indoor units 30 by two extension pipelines (the third extension pipeline 43 and the fourth extension pipeline 44), respectively.

That is, it is only necessary that the outdoor unit 10 and the relay unit 20 as well as the relay unit 20 and the indoor units 30 are connected to each other by two extension pipelines, respectively, and cost reduction of pipeline materials or drastic reduction of the number of installation processes can be realized. In general, the outdoor unit and the relay unit as well as the relay unit and the indoor unit are connected by four extension pipelines, respectively, but according to the air-conditioning apparatus 100 according to Embodiment 1, since the number of extension pipelines can be reduced by half, a cost of the number of the pipelines can be drastically reduced. Particularly in the case of installation in a building or the like, a cost of the pipeline length can be also drastically reduced.

Moreover, since the heat-source-side refrigerant flow direction switching unit 50 is disposed in the outdoor unit 10, the heat-source-side refrigerant discharged from the compressor 11 flows into the relay unit 20 through the second extension pipeline 42 all the time, while the heat-source-side refrigerant flowing out of the relay unit 20 flows into the outdoor unit 10 through the first extension pipe 41 all the time. Thus, in the first intermediate heat exchanger 21 and the second intermediate heat exchanger 22, the heat-source-side refrigerant cycle A and the use-side refrigerant cycle B are in the countercurrent form all the time, and the heat exchanger efficiency is raised. Also, since the heat-source-side refrigerant flow direction switching unit 50 is disposed in the outdoor unit 10, the heat-source-side refrigerant flowing out of the relay unit 20 passes through the first extension pipeline 41 all the time, and the thickness of the first extension pipeline 41 can be decreased, whereby the cost of the pipelines can be further reduced.

According to this air-conditioning apparatus 100, since the relay unit 20 and the indoor unit 30 are configured to be separable, prior-art equipment using a water refrigerant can be reused. That is, only by reusing the existing indoor units and extension pipelines (extension pipelines corresponding to the third extension pipeline 43 and the fourth extension pipeline 44 according to Embodiment 1) and connecting the relay unit 20 to them, the air-conditioning apparatus 100 according to Embodiment 1 can be configured easily. Also, since the existing indoor units and the extension pipelines can be reused, it is only necessary to connect and install only the relay unit 20, which is a common part, and the insides of rooms or the like in which the indoor units are installed are not affected. That is, the relay unit 20 can be connected without any restriction in construction.

According to the air-conditioning apparatus 100 according to Embodiment 1, since the refrigerant flow control device 25 is disposed not on the indoor unit 30 but on the relay unit 20, vibration caused by an increased flow of the refrigerant flowing into the refrigerant flow control device 25 or a refrigerant noise generated at this time does not transmit into a room or the like in which the indoor unit 30 is installed, and a silent indoor unit 30 can be provided. As a result, the air-conditioning apparatus 100 does not give a discomfort feeling to a user in a room or the like in which the indoor unit 30 is installed.

According to the air-conditioning apparatus 100 according to Embodiment 1, the refrigerant flow control device other than the refrigerant flow control device that performs an operation to expand the heat-source-side refrigerant can be bypassed, unnecessary pressure drop of the heat-source-side refrigerant can be prevented, and performances are improved. Also, according to the air-conditioning apparatus 100 according to Embodiment 1, during the cooling only operation mode and the heating only operation mode, the use-side refrigerant can be heated or cooled by both the first intermediate heat exchanger 21 and the second intermediate heat exchanger 22, and size reduction of the intermediate heat exchangers can be realized. Moreover, according to the air-conditioning apparatus 100 according to Embodiment 1, the use-side refrigerant can be supplied to the indoor units 30 both by the first pump 26 and the second pump 27, whereby the flow rate can be increased, and the performances of the air-conditioning apparatus 100 can be improved.

In the air-conditioning apparatus 100 according to this Embodiment 1, the example in which a refrigerant which releases heat while liquefying in the condenser is used as a heat-source-side refrigerant was described but this is not limiting, and the similar advantages can be obtained by using a refrigerant that releases heat while lowering the temperature in the supercritical state (such as carbon dioxide, which is one of natural refrigerants, for example) as a heat-source-side refrigerant. If such a refrigerant is used as the heat-source-side refrigerant, the above-described condenser operates as a radiator.

Embodiment 2

Figure 10:
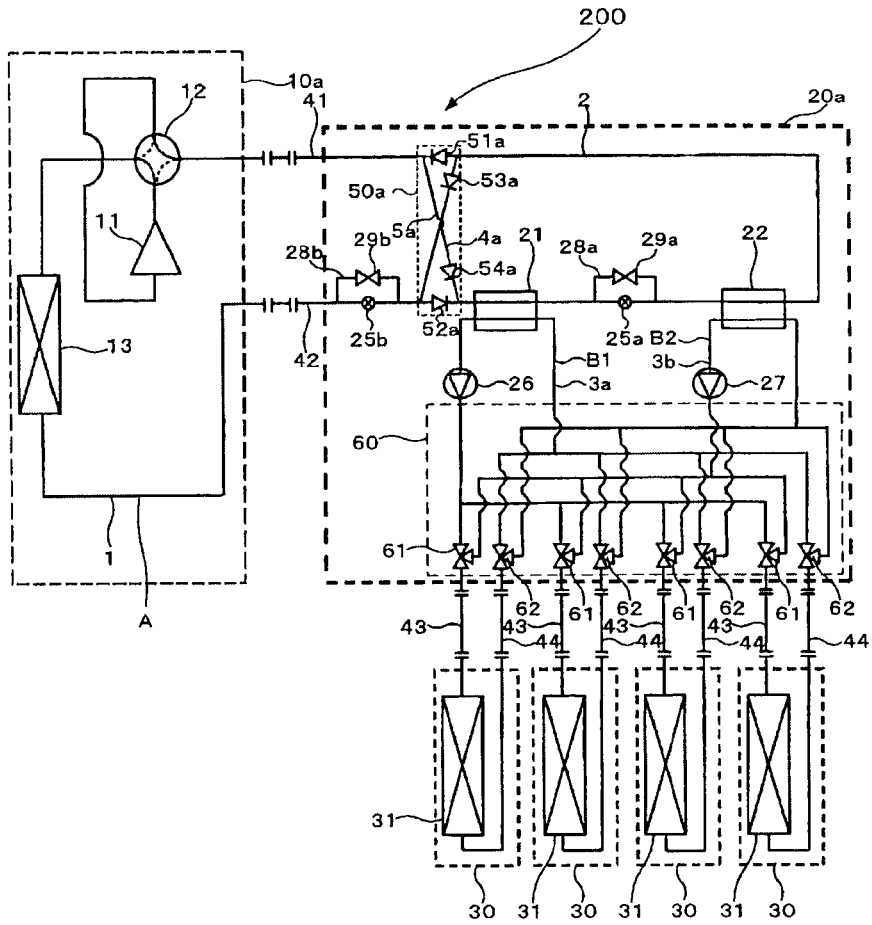
FIG. 10 is a circuit diagram illustrating a circuit configuration of an air-conditioning apparatus according to Embodiment 2 of the present invention.

FIG. 10 is a circuit diagram illustrating a circuit configuration of an air-conditioning apparatus 200 according to Embodiment 2 of the present invention. On the basis of FIG. 10, the circuit configuration of the air-conditioning apparatus 200 will be described. This air-conditioning apparatus 200 is installed in a building, an apartment house or the like and can supply a cooling load and a heating load at the same time by using a refrigeration cycle (heat-source-side refrigerant cycle and a use-side refrigerant cycle) through which a refrigerant (a heat-source-side refrigerant and a use-side refrigerant) is circulated. In Embodiment 2, differences from Embodiment 1 will be mainly described, and the same portions as those in Embodiment 1 will be given the same reference numerals and descriptions will be omitted.

As illustrated in FIG. 10, the air-conditioning apparatus 200 according to this Embodiment 2 is provided with a relay unit 20*a* in which a heat-source-side refrigerant flow direction switching unit 50*a* is provided on the basis of the configuration of the air-conditioning apparatus 100 according to Embodiment 1, and the heat-source-side refrigerant flow direction switching unit 50 is not disposed in the outdoor unit 10*a*. That is, in the air conditioning apparatus 200, the heat-source-side refrigerant flow direction switching unit 50*a* in the heat-source-side refrigerant cycle A is disposed in the relay unit 20*a*, and the second refrigerant flow control device 25*b*, the heat-source-side refrigerant flow direction switching unit 50*a*, the first intermediate heat exchanger 21, the first refrigerant flow control device 25*a*, the second intermediate heat exchanger 22, and the heat-source-side refrigerant flow direction switching unit 50*a* are disposed and connected by the heat-source-side refrigerant pipeline 2 in this order. Also, similarly to Embodiment 1, the second bypass pipe 28*b*, the second opening/closing valve 29*b*, the first bypass pipe 28*a*, and the first opening/closing valve 29*a* are disposed, but the third bypass pipe 28*c* and the third opening/closing valve 29*c* are not disposed.

The heat-source-side refrigerant flow direction switching unit 50*a* has a function of making the flow of the heat-source-side refrigerant flowing through the first intermediate heat exchanger 21 and the second intermediate heat exchanger 22 of the relay unit 20*a* to be in a constant direction regardless of the operation mode in which the indoor unit 30 executes. This heat-source-side refrigerant flow direction switching unit 50*a* is formed of a first connection pipeline 4*a*, a second connection pipeline 5*a*, a check valve 51*a*, a check valve 52*a*, a check valve 53*a* disposed in the first connection pipeline 4*a*, and a check valve 54*a* disposed in the second connection pipeline 5*a*. The first connection pipeline 4*a* connects the heat-source-side refrigerant pipeline 2 on the upstream side of the check valve 51*a* and the heat-source-side refrigerant pipeline 2 on the upstream side of the check valve 52*a* in the relay unit 20*a*. The second connection pipeline 5*a* connects the heat-source-side refrigerant pipeline 2 on the downstream side of the check valve 51*a* and the heat-source-side refrigerant pipeline 2 on the downstream side of the check valve 52*a* in the relay unit 20*a*.

The check valve 51*a* is disposed in the heat-source-side refrigerant pipeline 2 between the second intermediate heat exchanger 22 and the four-way valve 12 and allows the flow of the heat-source-side refrigerant only in a predetermined direction (direction from the second intermediate heat exchanger 22 to the four-way valve 12). The check valve 52*d* is disposed in the heat-source-side refrigerant pipeline 2 between the second refrigerant flow control device 25*b* and the first intermediate heat exchanger 21 and allows the flow of the heat-source-side refrigerant only in a predetermined direction (direction from the second refrigerant flow control device 25*b* to the first intermediate heat exchanger 21). The check valve 53*a* is disposed in the first connection pipeline 4*a* and allows communication of the heat-source-side refrigerant only in the direction from the heat-source-side refrigerant pipeline 2 connected to the first extension pipeline 41 to the heat-source-side refrigerant pipeline 2 connected to the second extension pipeline 42. The check valve 54*a* is disposed in the second connection pipeline 5*a* and allows communication of the heat-source-side refrigerant only in a direction from the heat-source-side refrigerant pipeline 2 connected to the first extension pipeline 41 to the heat-source-side refrigerant pipeline 2 connected to the second extension pipeline 42.

Here, each operation mode in which the air-conditioning apparatus 200 executes will be described. This air-conditioning apparatus 200 is capable of performing a cooling operation or a heating operation with the indoor units 30 thereof on the basis of an instruction from each indoor unit 30. That is, the air-conditioning apparatus 200 is capable of performing four operation modes (a cooling only operation mode, a heating only operation mode, a cooling-main operation mode, and a heating-main operation mode). The cooling only operation mode, the heating only operation mode, the cooling-main operation mode, and the heating-main operation mode in which the air-conditioning apparatus 200 operates will be described below with a flow of the refrigerant.

[Cooling Only Operation Mode]

Figure 11:
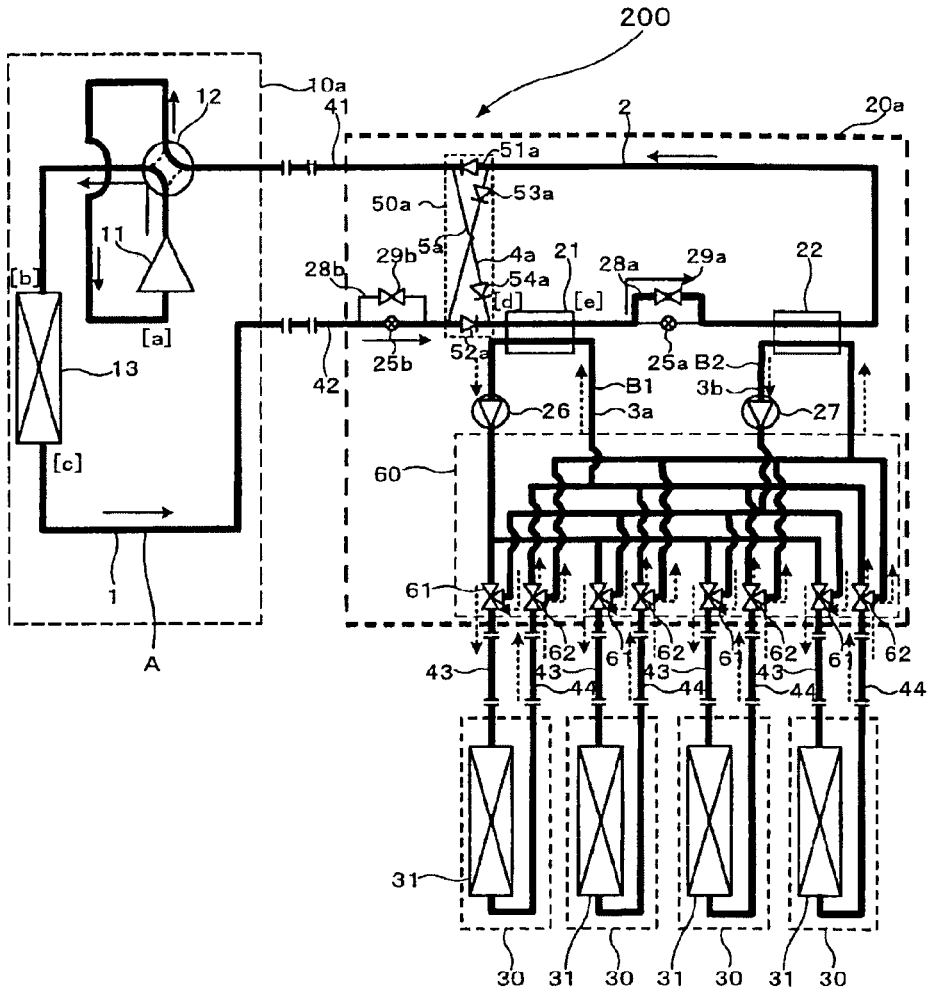
FIG. 11 is a refrigerant cycle diagram illustrating the flow of a refrigerant in a cooling only operation mode of the air-conditioning apparatus according to Embodiment 2 of the present invention.
Figure 12:
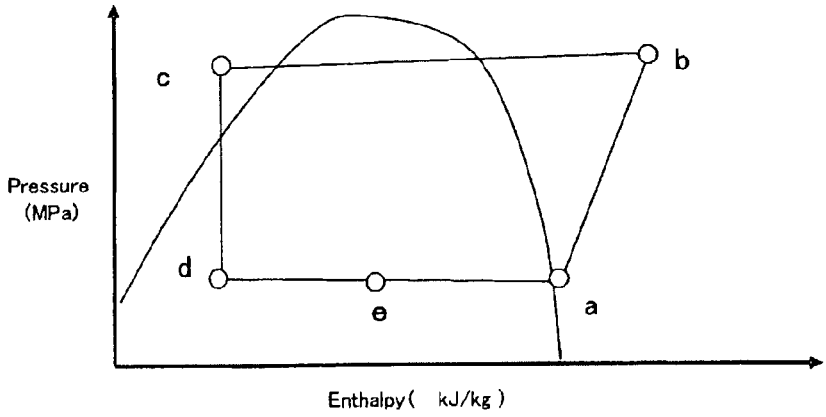
FIG. 12 is a p-h diagram illustrating transition of a heat-source-side refrigerant in the cooling only operation mode of the air-conditioning apparatus according to Embodiment 2 of the present invention.

FIG. 11 is a refrigerant cycle diagram illustrating the flow of a refrigerant in the cooling only operation mode of the air-conditioning apparatus 200. FIG. 12 is a p-h diagram (a diagram illustrating the relationship between the pressure of the refrigerant and enthalpy) illustrating transition of the heat-source-side refrigerant in this cooling only operation mode. In FIG. 11, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 12 correspond to the refrigerant states at [a] to [e] illustrated in FIG. 11, respectively.

If all the indoor units 30 perform the cooling operation, in the outdoor unit 10*a*, the four-way valve 12 is switched so that the heat-source-side refrigerant discharged from the compressor 11 flows into the outdoor heat exchanger 13. In the relay unit 20*a*, the opening degree of the second refrigerant flow control device 25*b* is decreased, the first refrigerant flow control device 25*a* is fully closed, the second opening/closing valve 29*b* is fully closed, the first opening/closing valve 29*a* is fully open, the first pump 26 and the second pump 27 are made to run, the first switching valve 61 and the second switching valve 62 of the use-side refrigerant flow direction switching unit 60 are switched so that the use-side refrigerant circulates between the first intermediate heat exchanger 21 as well as the second intermediate heat exchanger 22 and each of the indoor units 30. In this state, the operation of the compressor 11 is started. The first refrigerant flow control device 25*a* may be fully open.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. Assuming that heat does not go to or come from the periphery, this refrigerant compression process of the compressor 11 is represented by an isentropic line illustrated from the point [a] to the point [b] in FIG. 12. The high-temperature and high-pressure refrigerant discharged from the compressor 11 passes through the four-way valve 12 and flows into the outdoor heat exchanger 13. Then, the refrigerant is condensed and liquefied while releasing heat to the outdoor air in the outdoor heat exchanger 13 and becomes a high-pressure liquid refrigerant. The change of the refrigerant in the outdoor heat exchanger 13 progresses under the substantially constant pressure. The refrigerant change at this time is, considering the pressure loss of the outdoor heat exchanger 13, represented by a slightly inclined straight line close to horizontal as indicated from the point [b] to the point [c] in FIG. 12.

The high-pressure liquid refrigerant having flowed out of the outdoor heat exchanger 13 flows through the second extension pipeline 42 and flows into the relay unit 20. The high-pressure liquid refrigerant having flowed into the relay unit 20 is expanded (reduced) by the second refrigerant flow control device 25*b* and enters a low-temperature and low-pressure gas-liquid two-phase state. The change of the refrigerant in the second refrigerant flow control device 25*b* progresses under the constant enthalpy. The refrigerant change at this time is represented by a perpendicular line indicated from the point [c] to the point [d] in FIG. 12.

The gas-liquid two-phase refrigerant having flowed out of the second refrigerant flow control device 25*b* passes through the heat-source-side refrigerant flow direction switching unit 50*a* (check valve 52*a*) and flows into the first intermediate heat exchanger 21. The refrigerant having flowed into the first intermediate heat exchanger 21 takes heat away from the use-side refrigerant circulating through the first use-side refrigerant cycle B1 and enters the low-temperature and low-pressure gas-liquid two-phase state while cooling the use-side refrigerant. The change of the refrigerant in the first intermediate heat exchanger 21 progresses under the substantially constant pressure. The change of the refrigerant at this time is, considering the pressure loss in the first intermediate heat exchanger 21, represented by a slightly inclined straight line close to horizontal as indicated from the point [d] to [e] in FIG. 12.

The heat-source-side refrigerant having flowed out of the first intermediate heat exchanger 21 passes through the first bypass pipe 28*a* and the first opening/closing valve 29*a* and flows into the second intermediate heat exchanger 22. The refrigerant having flowed into the second intermediate heat exchanger 22 takes heat away from the use-side refrigerant circulating through the second use-side refrigerant cycle B2 and becomes a low-temperature and low-pressure vapor refrigerant while cooling the use-side refrigerant. The change of the refrigerant in the second intermediate heat exchanger 22 progresses under the substantially constant pressure. The change of the refrigerant is at this time, considering the pressure loss in the second intermediate heat exchanger 22, represented by a slightly inclined straight line close to horizontal as indicated from the point [e] to [a] in FIG. 12. The low-temperature and low-pressure vapor refrigerant having flowed out of the second intermediate heat exchanger 22 passes through the heat-source-side refrigerant flow direction switching unit 50*a* (check valve 51*a*), flows through the first extension pipeline 41, and returns to the compressor 11 through the four-way valve 12.

Since the flow of the use-side refrigerant in the use-side refrigerant cycle B is the same as that in Embodiment 1, descriptions will be omitted.

[Heating Only Operation Mode]

Figure 13:
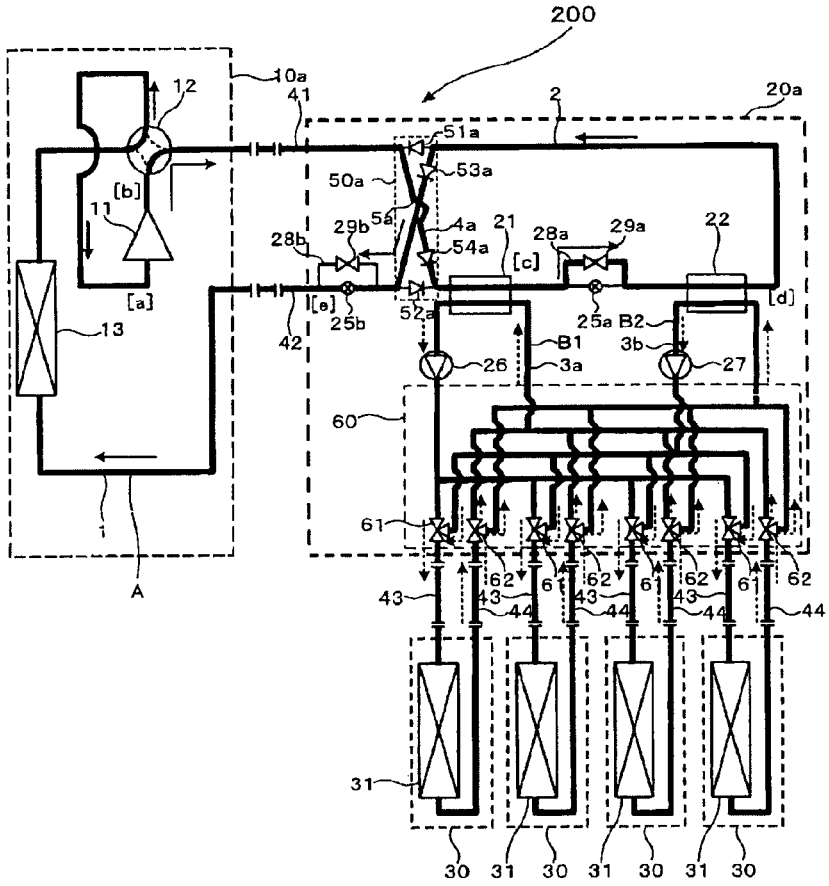
FIG. 13 is a refrigerant cycle diagram illustrating the flow of the refrigerant in a heating only operation mode of the air-conditioning apparatus according to Embodiment 2 of the present invention.
Figure 14:
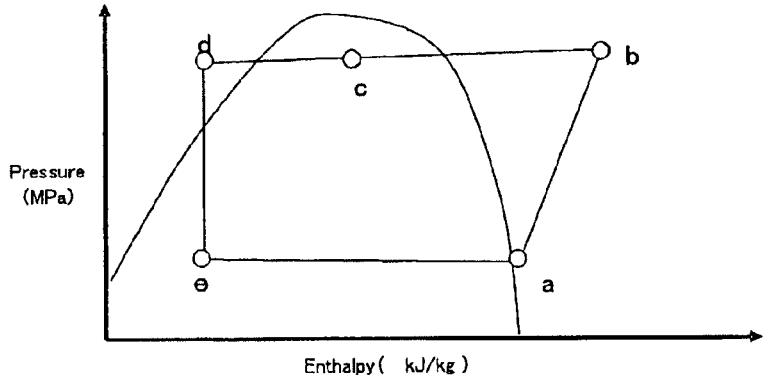
FIG. 14 is a p-h diagram illustrating transition of the heat-source-side refrigerant in the heating only operation mode of the air-conditioning apparatus according to Embodiment 2 of the present invention.

FIG. 13 is a refrigerant cycle diagram illustrating the flow of a refrigerant in the heating only operation mode of the air-conditioning apparatus 200. FIG. 14 is a p-h diagram (a diagram illustrating the relationship between the pressure of the refrigerant and enthalpy) illustrating transition of the heat-source-side refrigerant in this heating only operation mode. In FIG. 13, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 14 correspond to the refrigerant states at [a] to [e] illustrated in FIG. 13, respectively.

If all the indoor units 30 perform the heating operation, in the outdoor unit 10*a*, the four-way valve 12 is switched so that the heat-source-side refrigerant discharged from the compressor 11 flows into the relay unit 20*a* without going through the outdoor heat exchanger 13. In the relay unit 20*a*, the first refrigerant flow control device 25*a* is fully closed, the opening degree of the second refrigerant flow control device 25*b* is decreased, the first opening/closing valve 29*a* is fully open, the second opening/closing valve 29*b* is fully closed, the first pump 26 and the second pump 27 are made to run, the first switching valve 61 and the second switching valve 62 of the use-side refrigerant flow direction switching unit 60 are switched so that the use-side refrigerants from the first intermediate heat exchanger 21 and the second intermediate heat exchanger 22 circulate between them and each of the indoor units 30. In this state, the operation of the compressor 11 is started. The first refrigerant flow control device 25*a* may be fully open.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. This refrigerant compression process in the compressor 11 is represented by an isentropic line illustrated from the point [a] to the point [b] in FIG. 14. The high-temperature and high-pressure refrigerant discharged from the compressor 11 flows through the first extension pipeline 41 through the four-way valve 12, passes through the heat-source-side refrigerant flow direction switching unit 50*a* (check valve 54*a*) of the relay unit 20*a* and flows into the first intermediate heat exchanger 21. Then, the refrigerant having flowed into the first intermediate heat exchanger 21 is condensed and liquefied while releasing heat to the use-side refrigerant circulating through the first use-side refrigerant cycle B1 and becomes a high-pressure gas-liquid two-phase refrigerant. The refrigerant change at this time is represented by a slightly inclined straight line close to horizontal as indicated from the point [b] to the point [c] in FIG. 14.

The high-pressure gas-liquid two-phase refrigerant having flowed out of the first intermediate heat exchanger 21 passes through the first bypass pipe 28*a* and the first opening/closing valve 29*a* and flows into the second intermediate heat exchanger 22. The gas-liquid two-phase refrigerant having flowed into the second intermediate heat exchanger 22 is condensed and liquefied while releasing heat to the use-side refrigerant circulating through the second use-side refrigerant cycle B2 and becomes a high-pressure liquid refrigerant. The refrigerant change at this time is represented by a slightly inclined straight line close to horizontal indicated from the point [c] to the point [d] in FIG. 14. This liquid refrigerant passes through the heat-source-side refrigerant flow direction switching unit 50*a* (check valve 53*a*), expanded (reduced) by the second refrigerant flow control device 25*b* and enters the low-temperature and low-pressure gas-liquid two-phase state. The refrigerant change at this time is represented by the perpendicular line indicated from the point [d] to the point [e] in FIG. 14.

The refrigerant in the gas-liquid two-phase state having been expanded by the second refrigerant flow control device 25*b* flows through the heat-source-side refrigerant pipeline 2 and the first extension pipeline 41 and flows into the outdoor unit 10*a*. This refrigerant flows into the outdoor heat exchanger 13, takes away heat form the outdoor air and becomes a low-temperature and low-pressure vapor refrigerant. The refrigerant change at this time is represented by a slightly inclined straight line close to horizontal indicated from the point [e] to the point [a] in FIG. 14. The low-temperature and low-pressure vapor refrigerant having flowed out of the outdoor heat exchanger 13 returns to the compressor 11 through the four-way valve 12.

Since the flow of the use-side refrigerant in the use-side refrigerant cycle B is the same as that in Embodiment 1, descriptions will be omitted.

[Cooling-Main Operation Mode]

Figure 15:
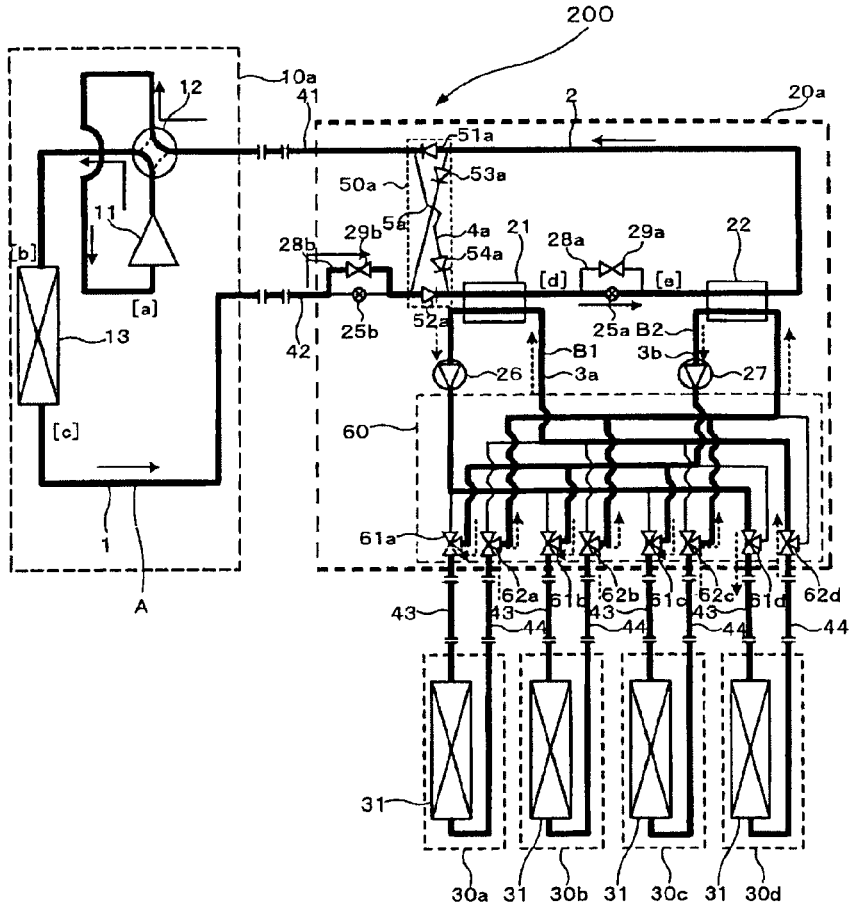
FIG. 15 is a refrigerant cycle diagram illustrating the flow of the refrigerant in a cooling-main operation mode of the air-conditioning apparatus according to Embodiment 2 of the present invention.
Figure 16:
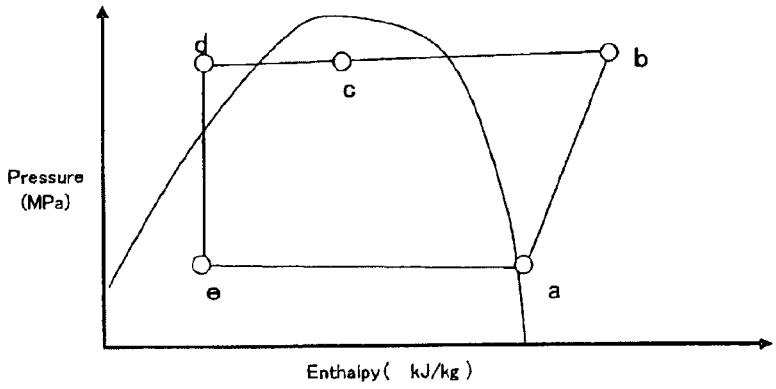
FIG. 16 is a p-h diagram illustrating transition of the heat-source-side refrigerant in the cooling-main operation mode of the air-conditioning apparatus according to Embodiment 2 of the present invention.

FIG. 15 is a refrigerant cycle diagram illustrating the flow of the refrigerant in the cooling-main operation mode of the air-conditioning apparatus 200. FIG. 16 is a p-h diagram (a diagram illustrating the relationship between the pressure of the refrigerant and enthalpy) illustrating transition of the heat-source-side refrigerant in this cooling-main operation mode. In FIG. 15, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 16 correspond to the refrigerant states at [a] to [e] illustrated in FIG. 15, respectively.

This cooling-main operation mode is a simultaneous cooling and heating operation mode in which three indoor units 30 perform a cooling operation and one indoor unit 30 performs a heating operation, for example, and the cooling load is larger. In FIG. 15, the three indoor units 30 performing the cooling operation are indicated as an indoor unit 30*a*, an indoor unit 30*b*, and an indoor unit 30*c* from the left side in the figure, and the one indoor unit 30 on the right side in the figure which performs the heating operation is indicated as an indoor unit 30*d*. Also, in accordance with the indoor unit 30*a* to the indoor unit 30*d*, the first switching valves 61 to be connected to each of them are indicated as a first switching valve 61*a* to a first switching valve 61*d*, and the second switching valves 62 connected to each of them are indicated as a second switching valve 62*a* to a second switching valve 62*d*.

If the indoor unit 30*a* to the indoor unit 30*c* perform the cooling operation and the indoor unit 30*d* performs the heating operation, in the outdoor unit 10*a*, the four-way valve 12 is switched so that the heat-source-side refrigerant discharged from the compressor 11 flows into the outdoor heat exchanger 13. In the relay unit 20*a*, the second refrigerant flow control device 25*b* is fully closed, the second opening/closing valve 29*b* is fully closed, the first opening/closing valve 29*a* is fully closed, the opening degree of the first refrigerant flow control device 25*a* is decreased, and the first pump 26 and the second pump 27 are made to run. The second refrigerant flow control device 25*b* may be fully open.

Also, in the use-side refrigerant flow direction switching unit 60 of the relay unit 20*a*, the first switching valve 61*a* to the first switching valve 61*c* and the second switching valve 62*a* to the second switching valve 62*c* are switched so that the use-side refrigerant circulates between the second intermediate heat exchanger 22 and the indoor unit 30*a* to the indoor unit 30*c*, and the first switching valve 61*d* and the second switching valve 62*d* are switched so that the use-side refrigerant circulates between the first intermediate heat exchanger 21 and the indoor unit 30*d*. In this state, the operation of the compressor 11 is started.

First, the flow of the heat-source-side refrigerant in the heat-source-side refrigerant cycle A will be described. A low-temperature and low-pressure vapor refrigerant is compressed by the compressor 11 and is discharged as a high-temperature and high-pressure refrigerant. This refrigerant compression process in the compressor 11 is represented by an isentropic line illustrated from the point [a] to the point [b] in FIG. 16. The high-temperature and high-pressure refrigerant discharged from the compressor 11 passes through the four-way valve 12 and flows into the outdoor heat exchanger 13. Then, the refrigerant is condensed and liquefied while releasing heat to the outdoor air in the outdoor heat exchanger 13 and becomes a high-pressure gas-liquid two-phase refrigerant. The refrigerant change at this time is represented by a slightly inclined straight line close to horizontal as indicated from the point [b] to the point [c] in FIG. 16.

The high-pressure gas-liquid two-phase refrigerant having flowed out of the outdoor heat exchanger 13 flows through the second extension pipeline 42 and flows into the relay unit 20*a*. The high-pressure gas-liquid two-phase refrigerant having flowed into the relay unit 20*a* passes through the second bypass pipe 28*b* and the second opening/closing valve 29*b*, passes through the heat-source-side refrigerant flow direction switching unit 50*a* (check valve 52*a*), is condensed and liquefied while releasing heat to the use-side refrigerant circulating through the first use-side refrigerant cycle B1 in the first intermediate heat exchanger 21 and becomes a high-pressure liquid refrigerant. That is, the first intermediate heat exchanger 21 functions as a condenser. The refrigerant change at this time is represented by a slightly inclined straight line close to horizontal as indicated from the point [c] to the point [d] in FIG. 16. The high-pressure liquid refrigerant having flowed out of the first intermediate heat exchanger 21 is expanded (reduced) by the first refrigerant flow control device 25*a* and enters the low-temperature and low-pressure gas-liquid two-phase state. The refrigerant change at this time is represented by a perpendicular line indicated from the point [d] to the point [e] in FIG. 16.

The gas-liquid two-phase refrigerant having been expanded in the first refrigerant flow control device 25*a* flows into the second intermediate heat exchanger 22. The refrigerant having flowed into the second intermediate heat exchanger 22 takes heat away from the use-side refrigerant circulating through the second use-side refrigerant cycle B2 while cooling the use-side refrigerant and becomes a low-temperature and low-pressure vapor refrigerant. That is, the second intermediate heat exchanger 22 functions as an evaporator. The refrigerant change at this time is represented by a slightly inclined straight line close to horizontal as indicated from the point [e] to [a] in FIG. 16. The low-temperature and low-pressure vapor refrigerant having flowed out of the second intermediate heat exchanger 22 passes through the heat-source-side refrigerant flow direction switching unit 50*a* (check valve 51*a*), flows through the heat-source-side refrigerant pipeline 2 and the first extension pipeline 41 and returns to the compressor 11 through the four-way valve 12.

Since the flow of the use-side refrigerant in the use-side refrigerant cycle B is the same as that in Embodiment 1, descriptions will be omitted.

[Heating-Main Operation Mode]

Figure 17:
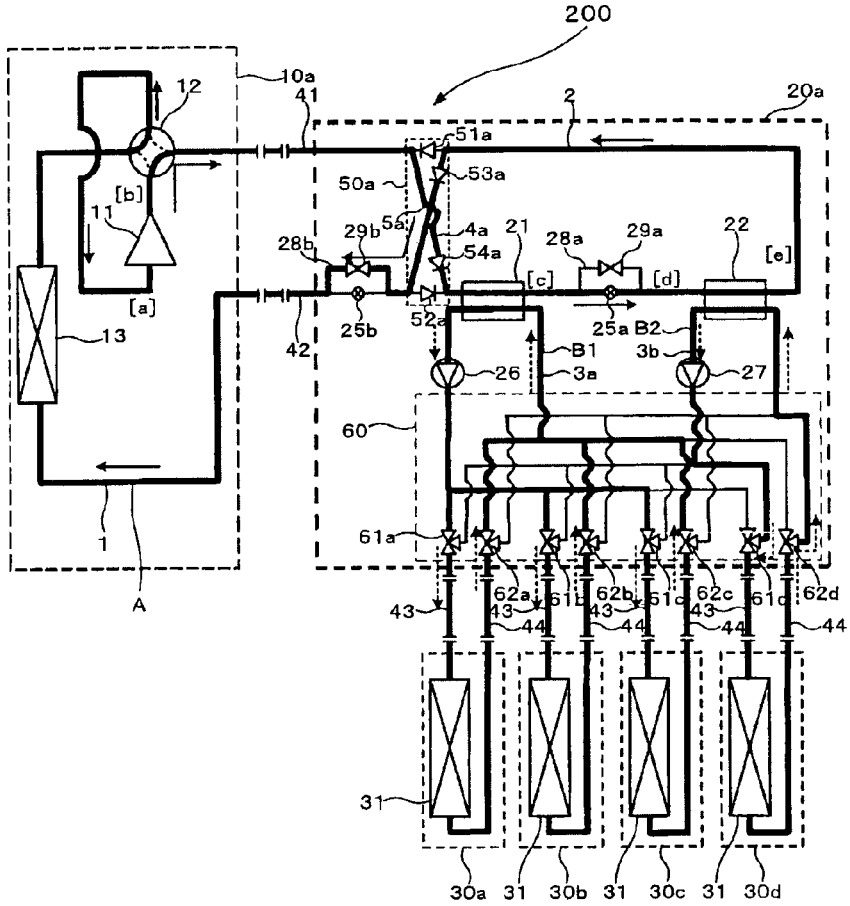
FIG. 17 is a refrigerant cycle diagram illustrating the flow of the refrigerant in a heating-main operation mode of the air-conditioning apparatus according to Embodiment 2 of the present invention.
Figure 18:
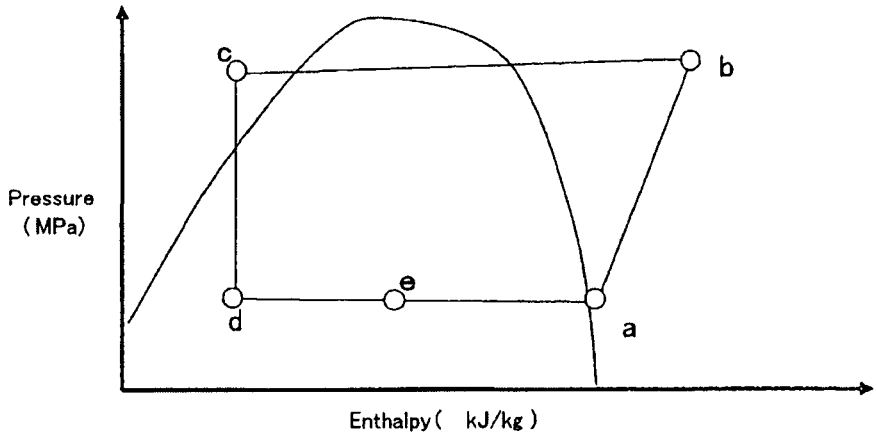
FIG. 18 is a p-h diagram illustrating transition of the heat-source-side refrigerant in the heating-main operation mode of the air-conditioning apparatus according to Embodiment 2 of the present invention.

FIG. 17 is a refrigerant cycle diagram illustrating the flow of the refrigerant in the heating-main operation mode of the air-conditioning apparatus 200. FIG. 18 is a p-h diagram (a diagram illustrating the relationship between the pressure of the refrigerant and enthalpy) illustrating transition of the heat-source-side refrigerant in this heating-main operation mode. In FIG. 17, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 18 correspond to the refrigerant states at [a] to [e] illustrated in FIG. 17, respectively.

This heating-main operation mode is a simultaneous cooling and heating operation mode in which three indoor units 30 perform a heating operation and one indoor unit 30 performs a cooling operation, for example, and the heating load is larger. In FIG. 17, the three indoor units 30 performing the heating operation are indicated as the indoor unit 30*a*, the indoor unit 30*b*, and the indoor unit 30*c* from the left side in the figure, and the one indoor unit 30 on the right side in the figure which performs the cooling operation is indicated as the indoor unit 30*d*. Also, in accordance with the indoor unit 30*a* to the indoor unit 30*d*, the first switching valves 61 to be connected to each of them are indicated as the first switching valve 61*a* to the first switching valve 61*d*, and the second switching valves 62 to be connected to each of them are indicated as the second switching valve 62*a* to the second switching valve 62*d*.

If the indoor unit 30*a* to the indoor unit 30*c* perform the heating operation and the indoor unit 30*d* performs the cooling operation, in the outdoor unit 10*a*, the four-way valve 12 is switched so that the heat-source-side refrigerant discharged from the compressor 11 flows into the relay unit 20*a* without going through the outdoor heat exchanger 13. In the relay unit 20*a*, the second refrigerant flow control device 25*b* is fully closed, the opening degree of the first refrigerant flow control device 25*a* is decreased, the first opening/closing valve 29*a* is fully closed, the second opening/closing valve 29*b* is fully open, and the first pump 26 and the second pump 27 are made to run. The second refrigerant flow control device 25*b* may be fully open.

Also, in the use-side refrigerant flow direction switching unit 60 of the relay unit 20*a*, the first switching valve 61*a* to the first switching valve 61*c* and the second switching valve 62*a* to the second switching valve 62*c* are switched so that the use-side refrigerant circulates between the first intermediate heat exchanger 21 and the indoor unit 30*a* to the indoor unit 30*c*, and the first switching valve 61*d* and the second switching valve 62*d* are switched so that the use-side refrigerant circulates between the second intermediate heat exchanger 22 and the indoor unit 30*d*. In this state, the operation of the compressor 11 is started.

First, the flow of the heat-source-side refrigerant in the heat-source-side refrigerant cycle A will be described. A low-temperature and low-pressure vapor refrigerant is compressed by the compressor 11, becomes a high-temperature and high-pressure refrigerant and is discharged. This refrigerant compression process in the compressor 11 is represented by an isentropic line illustrated from the point [a] to the point [b] in FIG. 18. The high-temperature and high-pressure refrigerant discharged from the compressor 11 flows through the first extension pipeline 41 through the four-way valve 12, flows into the relay unit 20*a*, and flows into the first intermediate heat exchanger 21 through the heat-source-side refrigerant flow direction switching unit 50*a* (check valve 54*a*). The refrigerant having flowed into the first intermediate heat exchanger 21 is condensed and liquefied while releasing heat to the use-side refrigerant circulating through the first use-side refrigerant cycle B1 and becomes a high-pressure liquid refrigerant. That is, the first intermediate heat exchanger 21 functions as a condenser. The refrigerant change at this time is represented by a slightly inclined straight line close to horizontal as indicated from the point [b] to the point [c] in FIG. 18.

The high-pressure liquid refrigerant having flowed out of the first intermediate heat exchanger 21 is expanded (reduced) by the first refrigerant flow control device 25*a* and enters a low-temperature and low-pressure gas-liquid two-phase state. The refrigerant change at this time is represented by a perpendicular line indicated from the point [c] to the point [d] in FIG. 18. The gas-liquid two-phase refrigerant having been expanded by the first refrigerant flow control device 25*a* flows into the second intermediate heat exchanger 22. The refrigerant having flowed into the second intermediate heat exchanger 22 takes heat away from the use-side refrigerant circulating through the second use-side refrigerant cycle B2 while cooling the use-side refrigerant and becomes a low-temperature and low-pressure gas-liquid two-phase refrigerant. That is, the second intermediate heat exchanger 22 functions as an evaporator. The refrigerant change at this time is represented by a slightly inclined straight line close to horizontal as indicated from the point [d] to [e] in FIG. 18.

The low-temperature and low-pressure gas-liquid two-phase refrigerant having flowed out of the second intermediate heat exchanger 22 passes through the second bypass pipe 28*b* and the second opening/closing valve 29*b* through the heat-source-side refrigerant flow direction switching unit 50*a* (check valve 53*a*), flows through the heat-source-side refrigerant pipeline 2 and the second extension pipeline 42, and flows into the outdoor unit 10*a*. This refrigerant flows into the outdoor heat exchanger 13. Then, the refrigerant takes away heat from the outdoor air in the outdoor heat exchanger 13 and becomes a low-temperature and low-pressure vapor refrigerant. The refrigerant change at this time is represented by a slightly inclined straight line close to horizontal as indicated from the point [e] to the point [a] in FIG. 18. The low-temperature and low-pressure vapor refrigerant having flowed out of the outdoor heat exchanger 13 returns to the compressor 11 through the four-way valve 12.

Since the flow of the use-side refrigerant in the use-side refrigerant cycle is the same as in Embodiment 1, descriptions will be omitted.

According to the air-conditioning apparatus 200 configured as above, the same advantages as those in Embodiment 1 can be obtained and also, the number of opening/closing valves (the third opening/closing valve 29*c* described in Embodiment 1) and bypass pipes (the third bypass pipe 28*c* described in Embodiment 1) can be reduced, the circuit configuration can be facilitated by that portion. Also, the heat-source-side refrigerant flowing through the opening/closing valve and the bypass pipe is in the gas-liquid two-phase state or the liquid state, and the density is 1/50 to 1/10 of the vapor refrigerant, and the flow velocity thereof is smaller. As a result, such an advantage can be obtained that a small-sized opening/closing valve or a bypass pipe having a small diameter can be used.

In the air-conditioning apparatus 200 according to Embodiment 2, the example in which the refrigerant that releases heat while being liquefied in the condenser is used as a heat-source-side refrigerant was described, but this is not limiting, and the similar advantages can be obtained by using a refrigerant that releases heat while lowering the temperature in the supercritical state (such as carbon dioxide, which is one of natural refrigerants, for example) as a heat-source-side refrigerant. If such a refrigerant is used as the heat-source-side refrigerant, the above-described condenser operates as a radiator.

Embodiment 3

Figure 19:
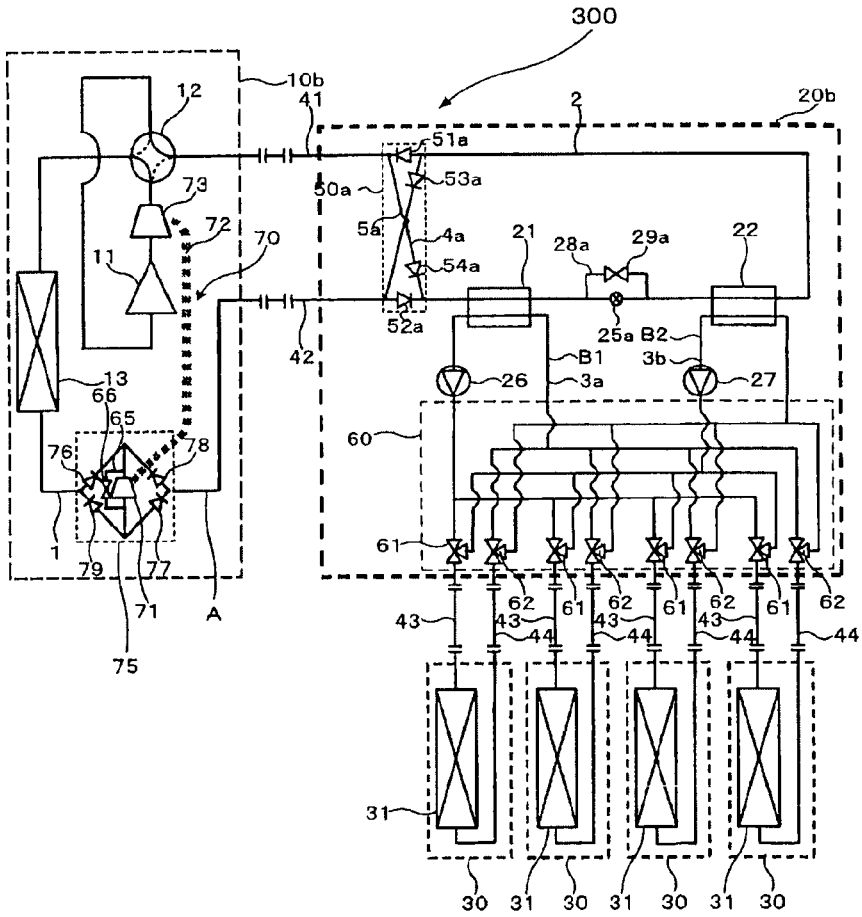
FIG. 19 is a circuit diagram illustrating a circuit configuration of an air-conditioning apparatus according to Embodiment 3 of the present invention.

FIG. 19 is a circuit diagram illustrating a circuit configuration of an air-conditioning apparatus 300 according to Embodiment 3 of the present invention. On the basis of FIG. 19, the circuit configuration of the air-conditioning apparatus 300 will be described. This air-conditioning apparatus 300 is installed in a building, an apartment house or the like and can supply a cooling load and a heating load at the same time by using a refrigeration cycle (heat-source-side refrigerant cycle and a use-side refrigerant cycle) through which a refrigerant (a heat-source-side refrigerant and a use-side refrigerant) is circulated. In Embodiment 3, differences from Embodiment 1 and Embodiment 2 will be mainly described, and the same portions as those in Embodiment 1 and Embodiment 2 will be given the same reference numerals and descriptions will be omitted.

As illustrated in FIG. 19, the air-conditioning apparatus 300 according to Embodiment 3 is provided with an outdoor unit 10*b* in which an expansion mechanism 70 and a second heat-source-side refrigerant flow direction switching unit 75 are provided on the basis of the configuration of the air-conditioning apparatus 200 according to Embodiment 2. Also, in a relay unit 20*b* of the air-conditioning apparatus 300, the second refrigerant flow control device 25*b* is not provided. That is, in the air conditioning apparatus 300, in the relay unit 20*b*, the heat-source-side refrigerant flow direction switching unit 50*a*, the first intermediate heat exchanger 21, the first refrigerant flow control device 25*a*, the second intermediate heat exchanger 22, and the heat-source-side refrigerant flow direction switching unit 50*a* are disposed and connected by the heat-source-side refrigerant pipeline 2 in this order. Also, similarly to Embodiment 1, the first bypass pipe 28*a* and the first opening/closing valve 29*a* are disposed.

The expansion mechanism 70 is formed of an expansion machine 71 which decompresses and expands the heat-source-side refrigerant, a power transmission device 72 which uses power recovered in the expansion machine 71 for a compression work of the heat-source-side refrigerant, and a sub compressor 73 which compresses the heat-source-side refrigerant by the power transmitted through the power transmission device 72. The second heat-source-side refrigerant flow direction switching unit 75 is provided with the expansion machine 71, a check valve 76, a check valve 77, a check valve 78, and a check valve 79 which keep the flow of the heat-source-side refrigerant in the expansion machine 71 in a certain direction, a bypass flow path 65 which bypasses the expansion machine 71, and a bypass opening/closing valve 66 which opens and closes the bypass flow path 65.

The expansion mechanism 70 has a function of recovering expansion power when the heat-source-side refrigerant is decompressed and of compressing the heat-source-side refrigerant by using the expansion power. The expansion machine 71 is disposed in the second heat-source-side refrigerant flow direction switching unit 75, reduces and expands the heat-source-side refrigerant flowing through the second heat-source-side refrigerant flow direction switching unit 75 and recovers the expansion power generated at that time. The power transmission device 72 is disposed so as to connect the expansion machine 71 and a sub compressor 73 and transmits the expansion power recovered in the expansion machine 71 to the sub compressor 73. The sub compressor 73 is disposed in the discharge side of the compressor 11 and further compresses the heat-source-side refrigerant discharged from the compressor 11 by the expansion power recovered by the expansion machine 71.

The second heat-source-side refrigerant flow direction switching unit 75 has a function of making the flow of the heat-source-side refrigerant flowing through the expansion machine 71 in a constant direction. That is, the second heat-source-side refrigerant flow direction switching unit 75 directs the flow of the heat-source-side refrigerant flowing into the expansion machine 71 in a constant direction (from the inlet side to the outlet side of the expansion machine 71) by the four check valves (the check valve 76 to the check valve 79) forming the second heat-source-side refrigerant flow direction switching unit 75. The expansion machine 71 is disposed in the refrigerant pipeline which connects the refrigerant pipeline between the check valve 76 and the check valve 78 to the refrigerant pipeline between the check valve 77 and the check valve 79. The bypass flow path 65 connects the upstream side and the downstream side of the expansion machine 71 so that the heat-source-side refrigerant can bypass the expansion machine 71. Through which of the expansion machine 71 or the bypass flow path 65 the heat-source-side refrigerant is made to flow can be selected by opening/closing the bypass opening/closing valve 66.

Here, each operation mode that the air-conditioning apparatus 300 performed will be described. The air-conditioning apparatus 300 is capable of performing a cooling operation or a heating operation with the indoor units 30 thereof on the basis of an instruction from each indoor unit 30. That is, the air-conditioning apparatus 300 is capable of performing four operation modes (a cooling only operation mode, a heating only operation mode, a cooling-main operation mode, and a heating-main operation mode). The cooling only operation mode, the heating only operation mode, the cooling-main operation mode, and the heating-main operation mode in which the air-conditioning apparatus 300 operates will be described below with a flow of the refrigerant.

[Cooling Only Operation Mode]

Figure 20:
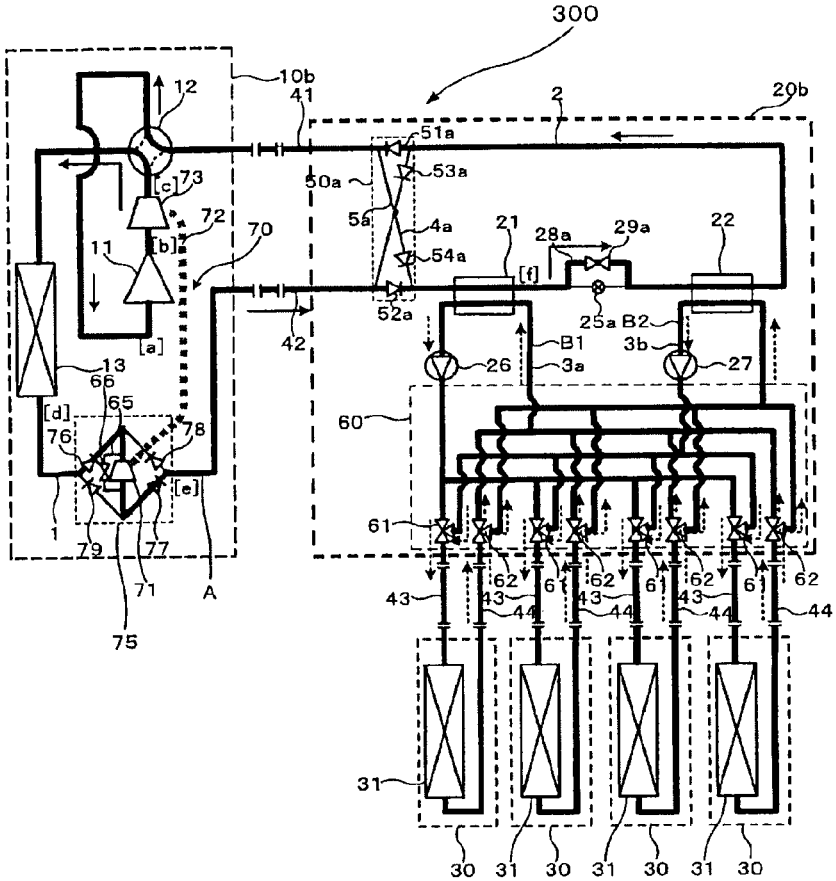
FIG. 20 is a refrigerant cycle diagram illustrating the flow of a refrigerant in a cooling only operation mode of the air-conditioning apparatus according to Embodiment 3 of the present invention.
Figure 21:
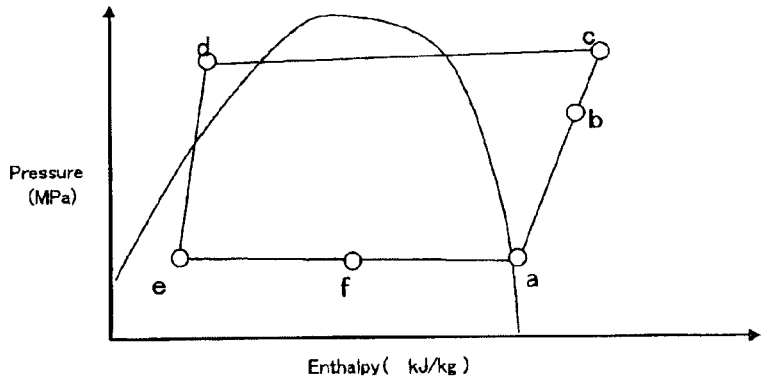
FIG. 21 is a p-h diagram illustrating transition of a heat-source-side refrigerant in the cooling only operation mode of the air-conditioning apparatus according to Embodiment 3 of the present invention.

FIG. 20 is a refrigerant cycle diagram illustrating the flow of a refrigerant in the cooling only operation mode of the air-conditioning apparatus 300. FIG. 21 is a p-h diagram (a diagram illustrating the relationship between the pressure of the refrigerant and enthalpy) illustrating transition of the heat-source-side refrigerant in this cooling only operation mode. In FIG. 20, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [f] illustrated in FIG. 21 correspond to the refrigerant states at [a] to [f] illustrated in FIG. 20, respectively.

If all the indoor units 30 perform the cooling operation, in the outdoor unit 10, the four-way valve 12 is switched so that the heat-source-side refrigerant discharged from the compressor 11 flows into the outdoor heat exchanger 13. In the relay unit 20*b*, the first opening/closing valve 29*a* is closed, the first refrigerant flow control device 25*a* is fully closed, the first pump 26 and the second pump 27 are made to run, and the first switching valve 61 and the second switching valve 62 of the use-side refrigerant flow direction switching unit 60 are switched so that the use-side refrigerant circulates between the first intermediate heat exchanger 21 as well as the second intermediate heat exchanger 22 and each of the indoor units 30. In this state, the operation of the compressor 11 is started. The first refrigerant flow control device 25*a* may be fully open.

First, the flow of the heat-source-side refrigerant in the heat-source-side refrigerant cycle A will be described. A low-temperature and low-pressure vapor refrigerant is compressed by the compressor 11 and is discharged as a high-temperature and high-pressure refrigerant. Assuming that heat does not go to or come from the periphery, this refrigerant compression process of the compressor 11 is represented by an isentropic line illustrated from the point [a] to the point [b] in FIG. 21. The refrigerant discharged from the compressor 11 is further compressed by the sub compressor 73 and changes to a high-temperature and high-pressure refrigerant. Assuming that heat does not go to or come from the periphery, this refrigerant compression process of the sub compressor 73 is represented by an isentropic line illustrated from the point [b] to the point [c] in FIG. 21.

The high-temperature and high-pressure refrigerant discharged from the sub compressor 73 passes through the four-way valve 12 and flows into the outdoor heat exchanger 13. Then, the refrigerant is condensed and liquefied while releasing heat to the outdoor air in the outdoor heat exchanger 13 and becomes a high-pressure liquid refrigerant. The change of the refrigerant in the outdoor heat exchanger 13 progresses under the substantially constant pressure. The refrigerant change at this time is, considering the pressure loss of the outdoor heat exchanger 13, represented by a slightly inclined straight line close to horizontal as indicated from the point [c] to the point [d] in FIG. 21.

The high-pressure liquid refrigerant having flowed out of the outdoor heat exchanger 13 flows through the check valve 76 of the second heat-source-side refrigerant flow direction switching unit 75, flows into the expansion machine 71, where the refrigerant is expanded (reduced), and enters a low-temperature and low-pressure gas-liquid two-phase state. The refrigerant change at this time is represented by an inclined straight line indicated from the point [d] to the point [e] in FIG. 21. In the refrigerant flow control device (second refrigerant flow control device 25*b*) as in Embodiment 2, the refrigerant changes under the constant enthalpy, but in the expansion machine 71 as in Embodiment 3, since power generated by expansion can be recovered, the change is represented by an inclined straight line. The power recovered by the expansion machine 71 is used as compression power of the sub compressor 73 by the power transmission device 72.

The gas-liquid two-phase refrigerant having flowed out of the expansion machine 71 passes through the check valve 77, flows through the second extension pipeline 42 and flows into the relay unit 20*b*. The refrigerant having flowed into the relay unit 20*b* passes through the heat-source-side refrigerant flow direction switching unit 50*a* (check valve 52*a*) and flows into the first intermediate heat exchanger 21. The refrigerant having flowed into the first intermediate heat exchanger 21 takes heat away from the use-side refrigerant circulating through the first use-side refrigerant cycle B1 while cooling the use-side refrigerant and enters the low-temperature and low-pressure gas-liquid two-phase state. The change of the refrigerant in the first intermediate heat exchanger 21 progresses under the substantially constant pressure. The refrigerant change at this time is, considering the pressure loss of the first intermediate heat exchanger 21, represented by a slightly inclined straight line close to horizontal as indicated from the point [e] to the point [f] in FIG. 21.

The heat-source-side refrigerant having flowed out of the first intermediate heat exchanger 21 passes through the first bypass pipe 28*a* and the first opening/closing valve 29*a* and flows into the second intermediate heat exchanger 22. The refrigerant having flowed into the second intermediate heat exchanger 22 takes heat away from the use-side refrigerant circulating through the second use-side refrigerant cycle 62 while cooling the use-side refrigerant and becomes a low-temperature and low-pressure vapor refrigerant. The change of the refrigerant in the second intermediate heat exchanger 22 progresses under the substantially constant pressure. The refrigerant change at this time is, considering the pressure loss of the second intermediate heat exchanger 22, represented by a slightly inclined straight line close to horizontal as indicated from the point [f] to [a] in FIG. 21. The low-temperature and low-pressure vapor refrigerant having flowed out of the second intermediate heat exchanger 22 passes through the heat-source-side refrigerant flow direction switching unit 50*a* (check valve 51*a*), flows through the first extension pipeline 41 and returns to the compressor 11 through the four-way valve 12.

Since the flow of the use-side refrigerant in the use-side refrigerant cycle B is the same as that in Embodiment 1, descriptions will be omitted.

[Heating Only Operation Mode]

Figure 22:
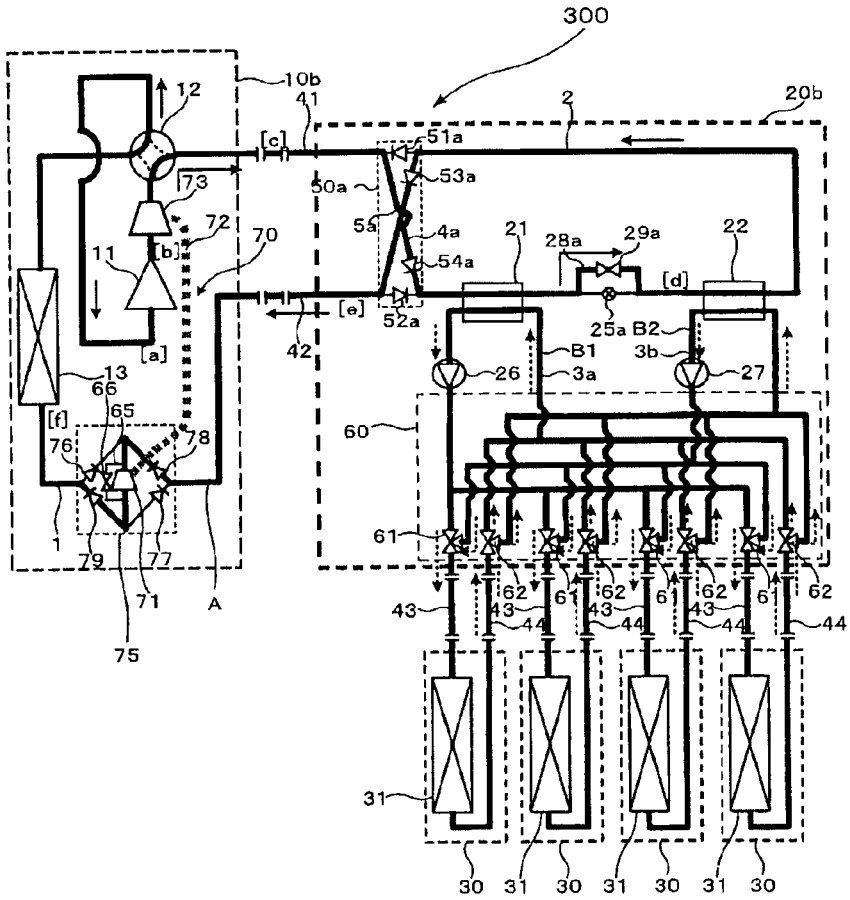
FIG. 22 is a refrigerant cycle diagram illustrating the flow of the refrigerant in a heating only operation mode of the air-conditioning apparatus according to Embodiment 3 of the present invention.
Figure 23:
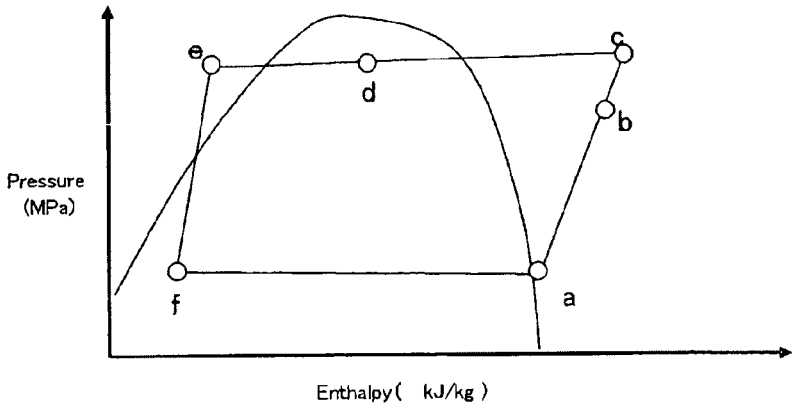
FIG. 23 is a p-h diagram illustrating transition of the heat-source-side refrigerant in the heating only operation mode of the air-conditioning apparatus according to Embodiment 3 of the present invention.

FIG. 22 is a refrigerant cycle diagram illustrating the flow of a refrigerant in the heating only operation mode of the air-conditioning apparatus 300. FIG. 23 is a p-h diagram (a diagram illustrating the relationship between the pressure of the refrigerant and enthalpy) illustrating transition of the heat-source-side refrigerant in this heating only operation mode. In FIG. 22, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [f] illustrated in FIG. 23 correspond to the refrigerant states at [a] to [f] illustrated in FIG. 22, respectively.

If all the indoor units 30 perform the heating operation, in the outdoor unit 10, the four-way valve 12 is switched so that the heat-source-side refrigerant discharged from the compressor 11 flows into the relay unit 20*b* without going through the outdoor heat exchanger 13. In the relay unit 20*b*, the first refrigerant flow control device 25*a* is fully closed, the first opening/closing valve 29*a* is fully open, the first pump 26 and the second pump 27 are made to run, the first switching valve 61 and the second switching valve 62 of the use-side refrigerant flow direction switching unit 60 are switched so that the use-side refrigerants from the first intermediate heat exchanger 21 and the second intermediate heat exchanger 22 circulate between them and each of the indoor units 30. In the outdoor unit 10, the bypass opening/closing valve 66 is closed. In this state, the operation of the compressor 11 is started.

First, the flow of the heat-source-side refrigerant in the heat-source-side refrigerant cycle A will be described. A low-temperature and low-pressure vapor refrigerant is compressed by the compressor 11 and is discharged as a high-temperature and high-pressure refrigerant. This refrigerant compression process in the compressor 11 is represented by an isentropic line illustrated from the point [a] to the point [b] in FIG. 23. The refrigerant having been discharged from the compressor 11 is further compressed by the sub compressor 73 and changes to a high-temperature and high-pressure refrigerant. Assuming that heat does not go to or come from the periphery, this refrigerant compression process in the sub compressor 73 is represented by an isentropic line illustrated from the point [b] to the point [c] in FIG. 23.

The high-temperature and high-pressure refrigerant discharged from the sub compressor 73 passes through the four-way valve 12, flows through the first extension pipeline 41, passes through the heat-source-side refrigerant flow direction switching unit 50*a* (check valve 54*a*) of the relay unit 20*b* and flows into the first intermediate heat exchanger 21. The refrigerant having flowed into the first intermediate heat exchanger 21 is condensed and liquefied while releasing heat to the use-side refrigerant circulating through the first use-side refrigerant cycle B1 and becomes a high-pressure gas-liquid two-phase refrigerant. The refrigerant change at this time is represented by a slightly inclined straight line close to horizontal indicated from the point [c] to the point [d] in FIG. 23.

The high-pressure gas-liquid two-phase refrigerant having flowed out of the first intermediate heat exchanger 21 passes through the first bypass pipe 28*a* and the first opening/closing valve 29*a* and flows into the second intermediate heat exchanger 22. The gas-liquid two-phase refrigerant having flowed into the second intermediate heat exchanger 22 is condensed and liquefied while releasing heat to the use-side refrigerant circulating through the second use-side refrigerant cycle B2 and becomes a high-pressure liquid refrigerant. The refrigerant change at this time is represented by a slightly inclined straight line close to horizontal indicated from the point [d] to the point [e] in FIG. 23. This liquid refrigerant passes through the heat-source-side refrigerant flow direction switching unit 50*a* (check valve 53*a*), flows through the second extension pipeline 42, flows into the second heat-source-side refrigerant flow direction switching unit 75 of the outdoor unit 10 and flows into the expansion machine 71 through the check valve 78.

The liquid refrigerant having flowed into the expansion machine 71 is expanded (reduced) by the expansion machine 71 and enters the low-temperature and low-pressure gas-liquid two-phase state. The refrigerant change at this time is represented by an inclined straight line indicated from the point [e] to the point [f] in FIG. 23. The power recovered by the expansion machine 71 is used as compression power of the sub compressor 73 by the power transmission device 72. The gas-liquid two-phase refrigerant having flowed out of the expansion machine 71 passes through the check valve 79, flows into the outdoor heat exchanger 13, takes heat away from the outdoor air and becomes a low-temperature and low-pressure vapor refrigerant. The refrigerant change at this time is represented by a slightly inclined straight line close to horizontal indicated from the point [f] to the point [a] in FIG.

23. The low-temperature and low-pressure vapor refrigerant having flowed out of the outdoor heat exchanger 13 returns to the compressor 11 through the four-way valve 12.

Since the flow of the use-side refrigerant in the use-side refrigerant cycle B is the same as that in Embodiment 1, descriptions will be omitted.

[Cooling-Main Operation Mode]

In the cooling-main operation mode, the bypass opening/closing valve 66 is fully open, the heat-source-side refrigerant is made to flow through the bypass flow path 65 so as to bypass the expansion machine 71, and the refrigerant is expanded (reduced) by the first refrigerant flow control device 25*a*. Since the other flows of the heat-source-side refrigerant and of the use-side refrigerant are the same as in Embodiment 2, descriptions will be omitted.

[Heating-Main Operation Mode]

In the heating-main operation mode, too, the bypass opening/closing valve 66 is fully open, the heat-source-side refrigerant is made to flow through the bypass flow path 65 so as to bypass the expansion machine 71, and the refrigerant is expanded (reduced) by the first refrigerant flow control device 25*a*. Since the other flows of the heat-source-side refrigerant and of the use-side refrigerant are the same as in Embodiment 2, descriptions will be omitted.

According to the air-conditioning apparatus 300 configured as above, the same advantages as in Embodiment 1 and Embodiment 2 are obtained and at the same time, since the refrigerant can be compressed by the expansion power of the refrigerant in the cooling only operation mode and the heating only operation mode, the efficiency of the air-conditioning apparatus 300 is further improved. Also, in Embodiment 3, the configuration in which the sub compressor 73 is disposed in the discharge side of the compressor 11 was described, but the same advantages are obtained by disposing the sub compressor 73 on the suction side of the compressor 11. Moreover, in Embodiment 3, the power obtained by the expansion machine 71 is used for the work of compressing the refrigerant by the power transmission device 72, but the same advantages are obtained by using a power generator instead of the sub compressor 73 and by taking out the recovered power as electric power.

In the air-conditioning apparatus 300 according to Embodiment 3, the example in which the refrigerant that releases heat while being liquefied by the condenser was used as the heat-source-side refrigerant was described, but this is not limiting, and the similar advantages can be obtained by using a refrigerant that releases heat while lowering the temperature in the supercritical state (such as carbon dioxide, which is one of natural refrigerants, for example) as the heat-source-side refrigerant. If such a refrigerant is used as the heat-source-side refrigerant, the above-described condenser operates as a radiator.

Embodiment 4

Figure 24:
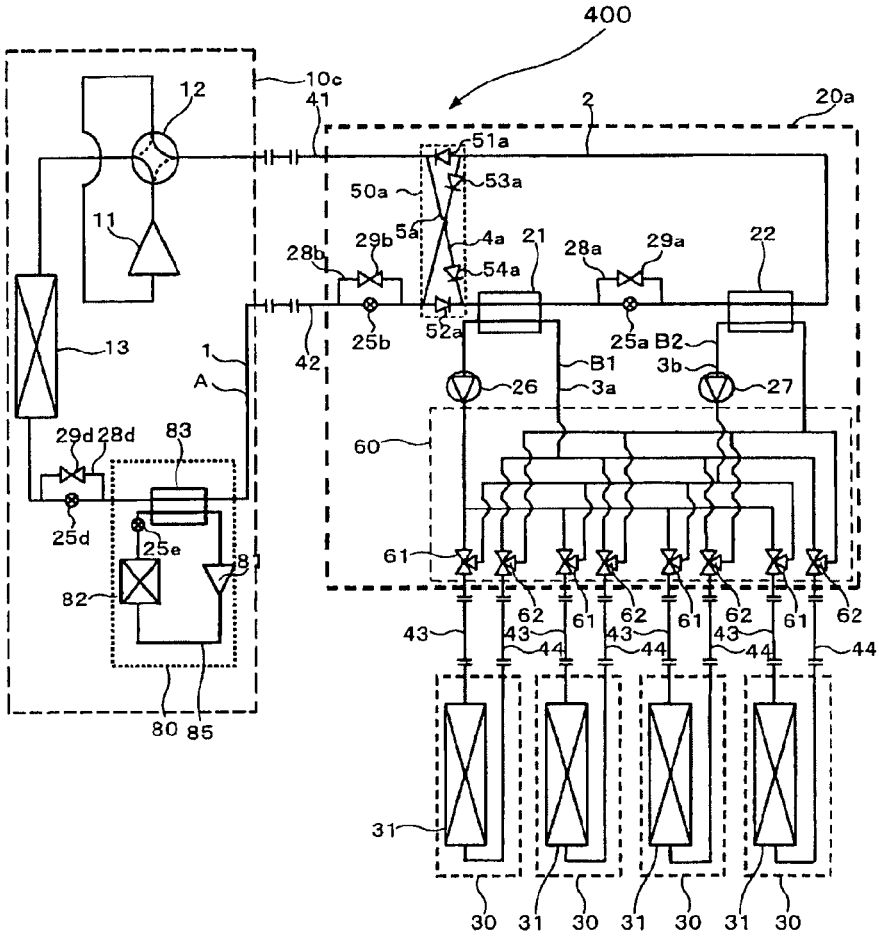
FIG. 24 is a circuit diagram illustrating a circuit configuration of an air-conditioning apparatus according to Embodiment 4 of the present invention.

FIG. 24 is a circuit diagram illustrating a circuit configuration of an air-conditioning apparatus 400 according to Embodiment 4 of the present invention. On the basis of FIG. 24, the circuit configuration of the air-conditioning apparatus 400 will be described. This air-conditioning apparatus 400 is installed in a building, an apartment house or the like and can supply a cooling load and a heating load at the same time by using a refrigeration cycle (heat-source-side refrigerant cycle and a use-side refrigerant cycle) through which a refrigerant (a heat-source-side refrigerant and a use-side refrigerant) is circulated. In Embodiment 4, differences from Embodiments 1 to 3 will be mainly described, and the same portions as those in Embodiments 1 to 3 will be given the same reference numerals and descriptions will be omitted.

As illustrated in FIG. 24, the air-conditioning apparatus 400 according to Embodiment 4 is provided with an outdoor unit 10*c* in which a cooling device 80, a fourth refrigerant flow control device 25*d*, a fourth bypass pipe 28*d*, and a fourth opening/closing valve 29*d* are provided on the basis of the configuration of the air-conditioning apparatus 200 according to Embodiment 2. In the outdoor unit 10*c*, on the heat-source-side refrigerant pipeline 1 between the outdoor heat exchanger 13 and the second refrigerant flow control device 25*b*, the fourth refrigerant flow control device 25*d* and the cooling device 80 are disposed in series in this order from the outdoor heat exchanger 13 side.

The cooling device 80 has a cooling capacity of approximately 10 to 30% of the cooling capacity of the air-conditioning apparatus 400. This cooling device 80 is configured by connecting a second compressor 81, a second outdoor heat exchanger 28, a fifth refrigerant flow control device 25*e*, and a heat exchanger (refrigerant-refrigerant heat exchanger) 83 in series by a refrigerant pipeline 85 in this order. The heat exchanger 83 among them is disposed in the heat-source-side refrigerant pipeline 1 between the outdoor heat exchanger 13 and the second refrigerant flow control device 25*b* so as to cool the heat-source-side refrigerant flowing through the heat-source-side refrigerant cycle A. That is, the heat-source-side refrigerant cycle A and the refrigerant cycle of the cooling device 80 are connected by the heat exchanger 83. The refrigerant circulating through the cooling device 80 may be a refrigerant similar to the heat-source-side refrigerant or may be a different refrigerant.

The second compressor 81 sucks the refrigerant, compresses and turns the refrigerant into a high-temperature and high-pressure state and may be formed of an inverter compressor capable of controlling capacity, for example. The second outdoor heat exchanger 82 functions as a condenser, exchanges heat between the air supplied from a fan, not shown, and the refrigerant and condenses and liquefies the refrigerant. The fifth refrigerant flow control device 25*e* functions as a pressure reducing valve or an expansion valve and reduces and expands the refrigerant. This fifth refrigerant flow control device 25*e* may be formed of a device capable of varying an opening degree such as an electronic expansion valve, for example. The heat exchanger 83 exchanges heat between the heat-source side refrigerant flowing through the heat-source-side refrigerant pipeline 1 and the refrigerant flowing through the refrigerant pipeline 85 and cools the heat-source-side refrigerant.

The fourth refrigerant flow control device 25*d* functions as a reducing valve or an expansion valve and reduces and expands the heat-source-side refrigerant. This fourth refrigerant flow control device 25*d* may be formed of a device capable of varying an opening degree such as an electronic expansion valve, for example. The fourth refrigerant flow control device 25*d* is disposed between the outdoor heat exchanger 13 and the heat exchanger 83. The fourth bypass pipe 28*d* connects the upstream side and the downstream side of the fourth refrigerant flow control device 25*d* so that the heat-source-side refrigerant can bypass the fourth refrigerant flow control device 25*d*. The fourth opening/closing valve 29*d* opens and closes the fourth bypass pipe 28*d*.

Here, each operation mode that the air-conditioning apparatus 400 performs will be described. This air-conditioning apparatus 400 is capable of performing a cooling operation or a heating operation with the indoor units 30 thereof on the basis of an instruction from each indoor unit 30. That is, the air-conditioning apparatus 400 is capable of performing four operation modes (a cooling only operation mode, a heating only operation mode, a cooling-main operation mode, and a heating-main operation mode). The cooling only operation mode, the heating only operation mode, the cooling-main operation mode, and the heating-main operation mode in which the air-conditioning apparatus 400 operates will be described below with a flow of the refrigerant.

[Cooling Only Operation Mode]

Figure 25:
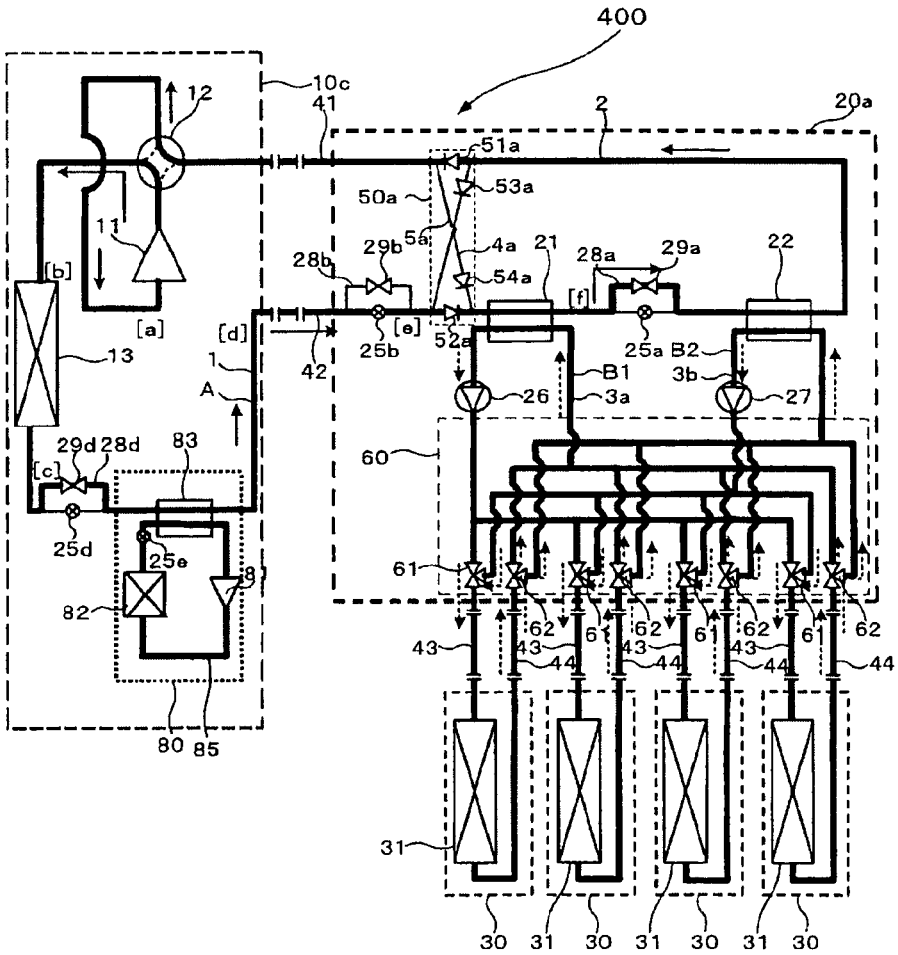
FIG. 25 is a refrigerant cycle diagram illustrating the flow of a refrigerant in a cooling only operation mode of the air-conditioning apparatus according to Embodiment 4 of the present invention.
Figure 26:
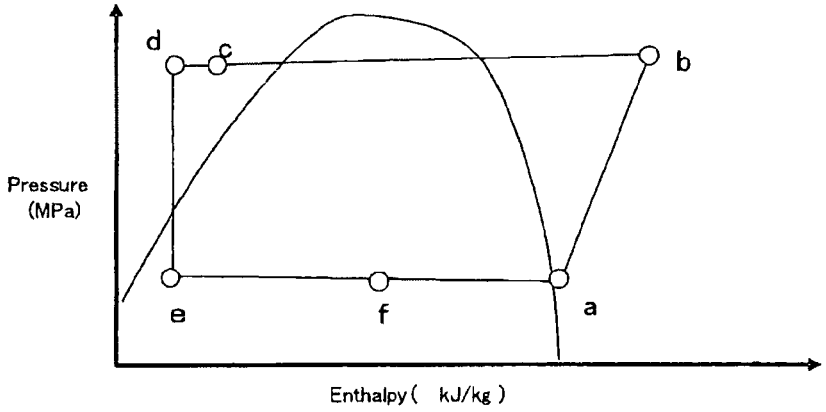
FIG. 26 is a p-h diagram illustrating transition of a heat-source-side refrigerant in the cooling only operation mode of the air-conditioning apparatus according to Embodiment 4 of the present invention.

FIG. 25 is a refrigerant cycle diagram illustrating the flow of a refrigerant in the cooling only operation mode of the air-conditioning apparatus 400. FIG. 26 is a p-h diagram (a diagram illustrating the relationship between the pressure of the refrigerant and enthalpy) illustrating transition of the heat-source-side refrigerant in this cooling only operation mode. In FIG. 25, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [f] illustrated in FIG. 26 correspond to the refrigerant states at [a] to [f] illustrated in FIG. 26, respectively.

If all the indoor units 30 perform the cooling operation, in the outdoor unit 10*c*, the fourth refrigerant flow control device 25*d* is fully closed, the fourth opening/closing valve 29*d* is open, and the second compressor 81 is made to run so as to cool the high-pressure liquid heat-source side refrigerant having flowed out of the outdoor heat exchanger 13 by the cooling device 80.

Since the other operations (the refrigerant state in the heat-source-side refrigerant cycle A and the use-side refrigerant cycle B other than the outdoor unit 10*c*) are the same as Embodiment 2, descriptions will be omitted. The fourth refrigerant flow control device 25*d* may be fully open.

[Heating Only Operation Mode]

Figure 27:
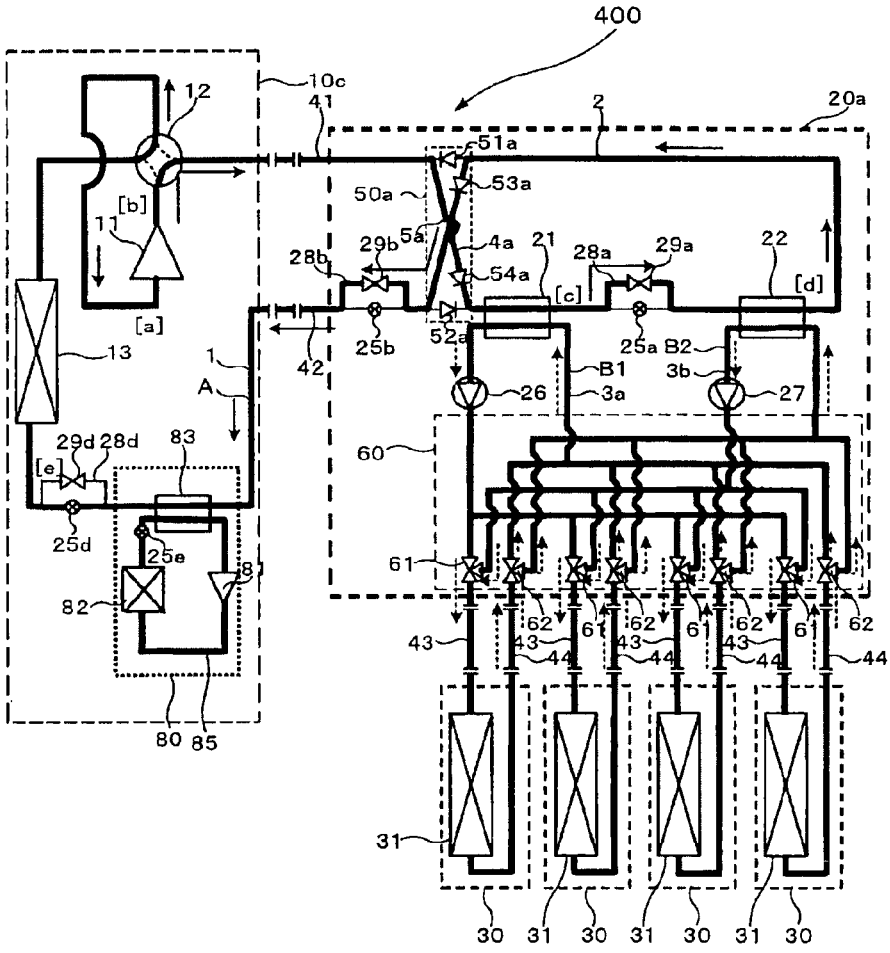
FIG. 27 is a refrigerant cycle diagram illustrating the flow of the refrigerant in a heating only operation mode of the air-conditioning apparatus according to Embodiment 4 of the present invention.
Figure 28:
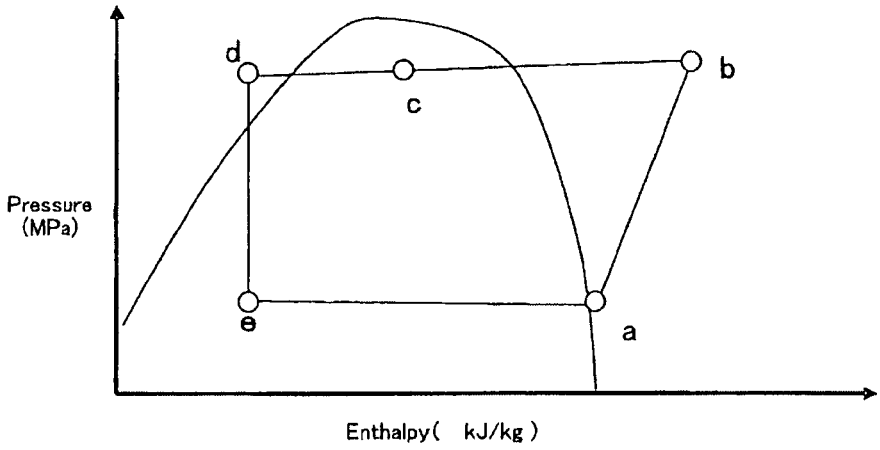
FIG. 28 is a p-h diagram illustrating transition of the heat-source-side refrigerant in the heating only operation mode of the air-conditioning apparatus according to Embodiment 4 of the present invention.

FIG. 27 is a refrigerant cycle diagram illustrating the flow of a refrigerant in the heating only operation mode of the air-conditioning apparatus 400. FIG. 28 is a p-h diagram (a diagram illustrating the relationship between the pressure of the refrigerant and enthalpy) illustrating transition of the heat-source-side refrigerant in this heating only operation mode. In FIG. 27, a pipeline illustrated by a bold line indicates a pipeline through which the refrigerant (the heat-source-side refrigerant and the use-side refrigerant) circulates. Also, the flow direction of the heat-source-side refrigerant is indicated by a solid-line arrow, while the flow direction of the use-side refrigerant by a broken-line arrow. Moreover, the refrigerant states at a point [a] to a point [e] illustrated in FIG. 28 correspond to the refrigerant states at [a] to [e] illustrated in FIG. 27, respectively.

If all the indoor units 30 perform the heating operation, in the outdoor unit 10*c*, the fourth opening/closing valve 29*d* is fully closed, the fourth refrigerant flow control device 25*d* is throttled, and the second compressor 81 is stopped so that the heat-source-side refrigerant having flowed out of the outdoor heat exchanger 13 is not cooled.

Since the other operations (the refrigerant state in the heat-source-side refrigerant cycle A and the use-side refrigerant cycle B other than the outdoor unit 10*c*) are the same as in Embodiment 2, descriptions will be omitted.

Also, although the fourth opening/closing valve 29*d* is fully closed, and the fourth refrigerant flow control device 25*d* is throttled so as to expand the refrigerant, it may be so configured that the fourth opening/closing valve 29*d* is fully open, the fourth refrigerant flow control device 25*d* is fully closed or fully open, the second opening/closing valve 29*b* is fully closed, and the second refrigerant flow control device 25*b* is throttled so as to expand the refrigerant. Moreover, the second opening/closing valve 29*b* and the fourth opening/closing valve 29*d* may be fully closed and both the second refrigerant flow control device 25*b* and the fourth refrigerant flow control device 25*d* may be throttled so as to expand the refrigerant.

[Cooling-Main Operation Mode]

In the cooling-main operation mode, the fourth opening/closing valve 29*d* is fully open and the second compressor 81 is stopped so that the heat-source-side refrigerant having flowed out of the outdoor heat exchanger 13 is not cooled.

Since the other flows of the heat-source-side refrigerant and of the use-side refrigerant are the same as in Embodiment 2, descriptions will be omitted.

[Heating Main Operation Mode]

In the heating-main operation mode, too, the fourth opening/closing valve 29*d* is fully open and the second compressor 81 is stopped so that the heat-source-side refrigerant flowing from the relay unit 20*b* into the outdoor unit 10*c* is not cooled.

Since the other flows of the heat-source-side refrigerant and of the use-side refrigerant are the same as in Embodiment 2, descriptions will be omitted.

According to the air-conditioning apparatus 400 configured as above, the same advantages as those in Embodiments 1 and 2 can be obtained, and at the same time, the supercooling degree of the heat-source-side refrigerant in the cooling only operation mode and the heating only operation mode can be increased, whereby the efficiency of the air-conditioning apparatus 400 is further improved. Particularly if a refrigerant that operates in the supercritical state such as carbon dioxide is used as the heat-source-side refrigerant, by using a hydrocarbon refrigerant, a Freon refrigerant or tetrafluoropropylene, which is excellent in refrigeration cycle efficiency for the refrigerant in the cooling device 80, the efficiency can be further improved.

In the air-conditioning apparatus 400 according to Embodiment 4, the example in which the refrigerant which releases heat while being liquefied in the condenser is used as a heat-source-side refrigerant was described, but this is not limiting, and the similar advantages can be obtained by using a refrigerant that releases heat while lowering the temperature in the supercritical state (such as carbon dioxide, which is one of natural refrigerants, for example) as a heat-source-side refrigerant. If such a refrigerant is used as the heat-source-side refrigerant, the above-described condenser operates as a radiator.

Embodiment 5

Figure 29:
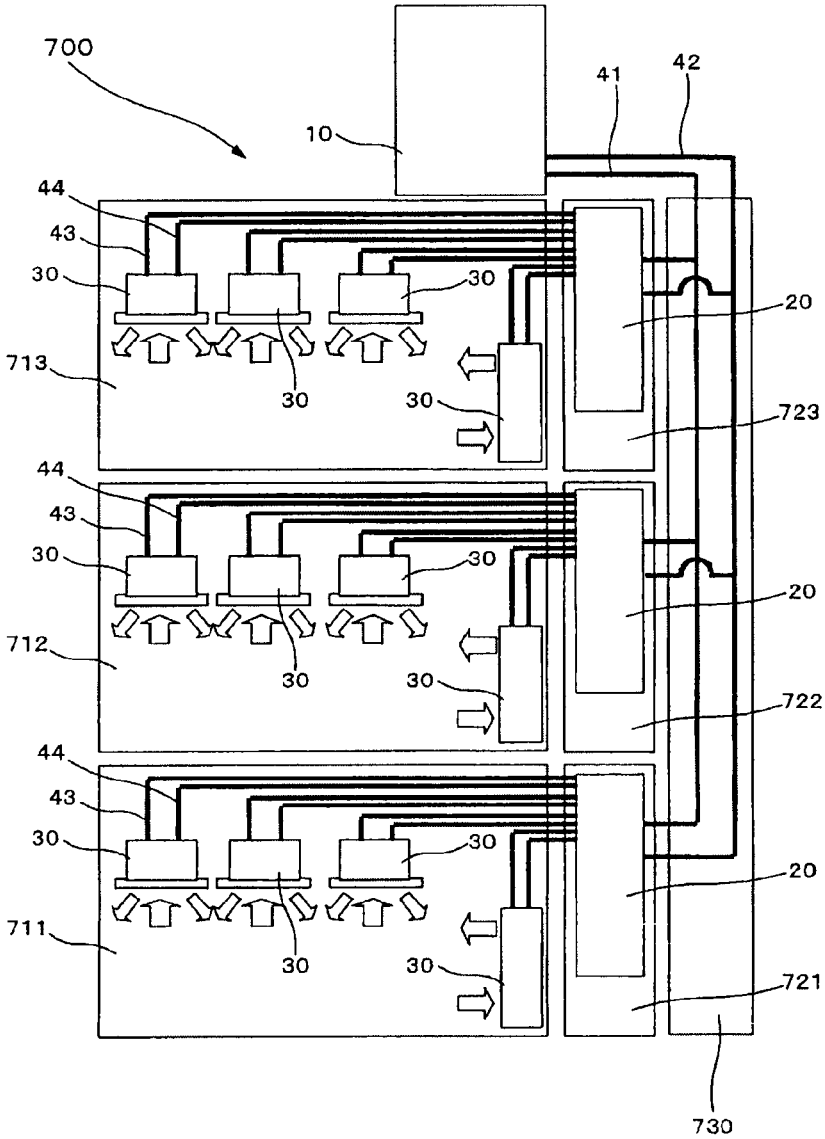
FIG. 29 is an installation outline diagram of an air-conditioning apparatus according to Embodiment 6.

FIG. 29 is an installation outline diagram of an air-conditioning apparatus according to Embodiment 5. In Embodiment 5, an example of installation methods of the air-conditioning apparatuses illustrated in Embodiments 1 to 4 in a building is shown. As illustrated in FIG. 29, the outdoor unit 10 (the outdoor unit 10*a*, the outdoor unit 10*b* or the outdoor unit 10*c*, and the same applies to the following) is installed on the roof of a building 700. In a common space 721 provided on the first floor of the building 700, the relay unit 20 (relay unit 20*a* or the relay unit 20*b*, the same applies to the following) is installed. In a living space 711 provided on the first floor of the building 700, four indoor units 30 are installed.

Similarly, in the second floor and the third floor of the building 700, the relay unit 20 is installed in a common space 722 and a common space 723, and four indoor units 30 are installed in a living space 712 and a living space 713. Here, the common space 721 to 723 are machine rooms, common corridors, lobbies and the like provided on each floor of the building 700. That is, the common space 721 to the common space 723 are spaces other than the living space 711 to the living space 713 provided on each floor of the building 700.

The relay unit 20 installed in the common space on each floor (the common space 721 to the common space 723) is connected to the outdoor unit 10 by the first extension pipeline 41 and the second extension pipeline 42 disposed in a pipeline installation space 730. Also, the indoor unit 30 installed in the living space on each floor (the living space 711 to the living space 713) is connected to the relay unit 20 installed in the common space on each floor by the third extension pipeline 43 and the fourth extension pipeline 44, respectively.

In the air-conditioning apparatus (the air-conditioning apparatus 100, the air-conditioning apparatus 200, the air-conditioning apparatus 300 or the air-conditioning apparatus 400) installed as above, since the use-side refrigerant such as water flows through the pipeline installed in the living space 711 to the living space 713, the heat-source-side refrigerant whose allowable concentration to leak into the space is regulated can be prevented from leaking into the living space 711 to the living space 713. Also, the indoor unit 30 on each floor becomes capable of the simultaneous cooling and heating operation.

Also, since the outdoor unit 10 and the relay unit 20 are provided on a location other than the living space, maintenance is facilitated. Also, since the relay unit 20 and the indoor units 30 are configured to be separable, when the air-conditioning apparatus is installed instead of equipment which has been using water refrigerant, the indoor units 30, the third extension pipeline 43, and the fourth extension pipeline 44 can be reused. The outdoor unit 10 does not necessarily have to be installed on the roof of the building 700 but may be installed underground or in a machine room on each floor or the like.

Specific embodiments of the present invention have been described, but they are not limiting and various variations or changes can be made without departing from the scope and the spirit of the present invention. Also, two three-way switching valves may be disposed instead of the four-way valve 12 installed in the outdoor unit 10. In each of the embodiments, the term "unit" in the outdoor unit 10 and the indoor units 30 do not necessarily mean that all the constituent elements are disposed in the same housing or on the housing outer wall. For example, even if the heat-source-side refrigerant flow direction switching unit 50 of the outdoor unit 10 is arranged at a location different from the housing in which the outdoor heat exchanger 13 is housed, the configuration is included in the scope of the present invention.

In each Embodiment, the example in which the first switching valve 61 and the second switching valve 62 disposed in the use-side refrigerant flow direction switching unit 60 are three-way valves was described, but this is not limiting. For example, two two-way switching valves may be disposed instead of the three-way valve so as to constitute the use-side refrigerant flow direction switching unit 60. According to such configuration, the flow direction of the refrigerant flowing through the two-way switching valve can be made constant all the time in any of the operation mode executed by the air-conditioning apparatus, and a seal structure of the valve can be simplified.

Also, even if the first pump 26 and the second pump 27 of the relay unit 20 are arranged at a location different from the housing in which the first intermediate heat exchanger 21 and the second intermediate heat exchanger 22 are housed, the configuration is included in the scope of the present invention. Moreover, it may be so configured that a set of the outdoor heat exchanger 13 and the compressor 11 is provided in plural in the outdoor unit 10, the refrigerant flowing out of each set is merged and guided into the second extension pipeline 42 and made to flow into the relay unit 20, while the refrigerant flowing out of the relay unit 20 is guided into the first extension pipeline 41 and branched and made to flow into each set.

Moreover, in the use-side refrigerant pipeline 3 of the air-conditioning apparatus, a strainer which traps dusts and the like in the use-side refrigerant, an expansion tank that prevents pipeline breakage caused by expansion of the use-side refrigerant, a constant pressure valve that adjusts discharge pressures of the first pump 26 and the second pump 27 or the like is not disposed, but an auxiliary machine that prevents valve clogging or the like of the first pump 26 and the second pump 27 may be provided. Furthermore, in Embodiment 1, the example in which the heat-source-side refrigerant flow direction switching unit 50 is disposed in the outdoor unit 10, and the heat-source-side refrigerant cycle A and the use-side refrigerant cycle B are configured in a countercurrent form in the first intermediate heat exchanger 21 and the second intermediate heat exchanger 22 is shown, but this is not limiting.

The invention claimed is:

1. An air-conditioning apparatus comprising:

a heat-source-side refrigerant cycle in which a compressor, an outdoor heat exchanger, a plurality of intermediate heat exchangers, and a first refrigerant flow control device disposed between each of the intermediate heat exchangers are connected in series, and a first bypass pipe which bypasses the first refrigerant flow control device through a first opening/closing device is disposed; and a plurality of use-side refrigerant cycles in which a plurality of indoor heat exchangers are connected in parallel with the plurality of intermediate heat exchangers, respectively, wherein the compressor and the outdoor heat exchanger are disposed in an outdoor unit;

the plurality of intermediate heat exchangers, the first refrigerant flow control device, the first bypass pipe, and the first opening/closing device are disposed in a relay unit;

the indoor heat exchanger is disposed in each of a plurality of indoor units;

each of the plurality of intermediate heat exchangers exchanges heat between a heat-source-side refrigerant circulating through the heat-source-side refrigerant cycle and a use-side refrigerant circulating through the use-side refrigerant cycle.

2. The air-conditioning apparatus of claim 1, further comprising:

a second refrigerant flow control device disposed in an inlet side of an intermediate heat exchanger located in an upstream position among the plurality of intermediate heat exchangers; and a second bypass pipe which bypasses the second refrigerant flow control device through a second opening/closing device.

3. The air-conditioning apparatus of claim 2, further comprising:

a third refrigerant flow control device disposed in an outlet side of an intermediate heat exchanger located on a downstream side among the plurality of intermediate heat exchangers; and a third bypass pipe which bypasses the third refrigerant flow control device through a third opening/closing device.

4. The air-conditioning apparatus of claim 1, the outdoor unit further comprising:

an expansion machine which recovers expansion power when the heat-source-side refrigerant is expanded; and a sub compressor which compresses the heat-source-side refrigerant by using the expansion power are disposed in, the air-conditioning apparatus wherein the expansion machine is disposed between the outdoor heat exchanger and the plurality of intermediate heat exchangers and the sub compressor is disposed in a discharge side or a suction side of the compressor.

5. The air-conditioning apparatus of claim 2, the outdoor unit further comprising:

a fourth refrigerant flow control device disposed between the outdoor heat exchanger in the heat-source-side refrigerant cycle and the second refrigerant flow control device; a fourth bypass pipe which bypasses the fourth refrigerant flow control device through a fourth opening/closing device; and a cooling device that cools the heat-source-side refrigerant flowing through the heat-source-side refrigerant cycle in between the second refrigerant flow control device and the fourth refrigerant flow control device, the air-conditioning apparatus wherein the cooling device is formed by connecting a second compressor, a second outdoor heat exchanger, a fifth refrigerant flow control device, and a refrigerant-refrigerant heat exchanger in series in this order and cools the heat-source-side refrigerant flowing through the heat-source-side refrigerant cycle by the refrigerant-refrigerant heat exchanger disposed between the second refrigerant flow control device and the fourth refrigerant flow control device.

6. The air-conditioning apparatus of claim 1, wherein a refrigerant flow direction switching unit which keeps the flow direction of the refrigerant from the heat source side in the plurality of intermediate heat exchangers to one direction is disposed in the outdoor unit or the relay unit.

7. The air-conditioning apparatus of claim 4, wherein a second refrigerant flow direction switching unit which keeps the flow direction of the heat-source-side refrigerant flowing into the expansion machine to one direction is disposed in the outdoor unit.

8. The air-conditioning apparatus of claim 1, the relay unit further comprising a use-side refrigerant flow direction switching unit which can selectively switch the plurality of use-side refrigerant cycles, the air-conditioning apparatus wherein the use-side refrigerant flow direction switching unit connects any one of or a plurality of the plurality of intermediate heat exchangers to the selected indoor heat exchanger.

9. The air-conditioning apparatus of claim 1, wherein in the plurality of intermediate heat exchangers disposed in the relay unit, the heat-source-side refrigerant flowing from the heat-source-side refrigerant cycle and the use-side refrigerant circulating through the use-side refrigerant cycle are arranged in a countercurrent form.

10. The air-conditioning apparatus of claim 1, wherein the relay unit and each of the plurality of indoor units are connected to each other by two extension pipelines.

11. The air-conditioning apparatus of claim 1, wherein at least one of water and an anti-freezing solution is used for the use-side refrigerant circulating through the use-side refrigerant cycle.

12. The air-conditioning apparatus of claim 1, wherein a natural refrigerant or a refrigerant having global warming potential smaller than that of a Freon refrigerant is used for the heat-source-side refrigerant circulating through the heat-source-side refrigerant cycle.

13. The air-conditioning apparatus of claim 1, wherein in the plurality of intermediate heat exchangers, the heat-source-side refrigerant is not condensed but heats the use-side refrigerant in the supercritical state.

14. The air-conditioning apparatus of claim 1, wherein the indoor unit is installed in a living space provided on each floor of a building; and the outdoor unit and the relay unit are installed in other than the living space.

15. The air-conditioning apparatus of claim 14, wherein the relay unit is installed in a common space provided in the building.

* * * * *